US009327528B2

(12) United States Patent
Hakamata

(10) Patent No.: US 9,327,528 B2
(45) Date of Patent: May 3, 2016

(54) PRINTING APPARATUS AND CONTROL METHOD

(71) Applicant: CANON KABUSHIKI KAISHA, Tokyo (JP)

(72) Inventor: Keisei Hakamata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/326,497

(22) Filed: Jul. 9, 2014

(65) Prior Publication Data

US 2015/0022577 A1 Jan. 22, 2015

(30) Foreign Application Priority Data

Jul. 16, 2013 (JP) ..... 2013-147924

(51) Int. Cl.
*B41J 29/38* (2006.01)
*B41J 13/00* (2006.01)
*B41J 23/02* (2006.01)

(52) U.S. Cl.
CPC ..... *B41J 13/0009* (2013.01); *B41J 13/0018* (2013.01); *B41J 23/025* (2013.01)

(58) Field of Classification Search
CPC ..... B41J 23/025
See application file for complete search history.

(56) References Cited

U.S. PATENT DOCUMENTS

| | | | | |
|---|---|---|---|---|
| 8,201,817 | B1 * | 6/2012 | Boo | 271/10.13 |
| 2001/0030763 | A1 * | 10/2001 | Nishiberi et al. | 358/1.12 |
| 2001/0033050 | A1 * | 10/2001 | Kinoshita et al. | 271/3.17 |
| 2013/0043643 | A1 | 2/2013 | Hakamata | |
| 2013/0043648 | A1 | 2/2013 | Hakamata | |
| 2013/0256976 | A1 * | 10/2013 | Samoto | B65H 5/06 271/10.11 |
| 2013/0278664 | A1 * | 10/2013 | Arakane et al. | 347/16 |

FOREIGN PATENT DOCUMENTS

JP 2001-310833 A 11/2001

OTHER PUBLICATIONS

Machine generated English translation of JP2001-310833 Recording Device to Nishihata et al.; translation generated via http://www19.ipdl.inpit.go.jp/PA1/cgi-bin/PA1INDEX on Dec. 30, 2014; 6 pp.*

* cited by examiner

*Primary Examiner* — Shelby Fidler
(74) *Attorney, Agent, or Firm* — Fitzpatrick, Cella, Harper & Scinto

(57) ABSTRACT

A printing apparatus according to the present invention includes a printing unit, a conveying unit, a driving source driving the conveying unit, a feeding unit, a discharging unit, a control unit, a switching mechanism switching a driving state of the feeding unit and a restricting mechanism restricting backward feeding of the discharging unit. The control unit changes a timing of feeding the subsequent printing medium in accordance with a printing start position of the subsequent printing medium.

14 Claims, 15 Drawing Sheets

PRINTING APPARATUS AND CONTROL METHOD

BACKGROUND OF THE INVENTION

1. Field of the Invention

The present invention relates to a printing apparatus and control method.

2. Description of the Related Art

A conveying mechanism including a plurality of rollers is known as a conveying mechanism for a printing medium (for example, paper) in a printing apparatus such as a printer, copying machine, or facsimile apparatus. A conveying mechanism of this type includes, for example, a feeding roller, conveying roller, and discharging roller. The feeding roller conveys, for example, a stacked printing medium to the conveying roller. The conveying roller conveys a printing medium during, for example, printing of an image. The discharging roller conveys, for example, a printing medium on which an image has been printed, and discharges it from the apparatus. The feeding roller and conveying roller are sometimes used for skew correction of a printing medium. In skew correction, for example, the leading end of a printing medium is abutted against the conveying roller by conveyance by the feeding roller so that the leading end of the printing medium uniformly abuts against the conveying roller in the whole region.

To increase the total printing speed when continuously performing a printing operation on printing media of a plurality of pages, the timing to start the feeding operation of a subsequent printing medium (of the next page) is preferably as early as possible after the end of a printing operation for a preceding page. However, an excessively early feeding start timing sometimes causes trouble.

Japanese Patent Laid-Open No. 2001-310833 has proposed an apparatus which changes the feeding start timing of a subsequent printing medium based on a margin amount from the leading end of the subsequent printing medium to a printing start position. When continuously performing the printing operation on printing media of a plurality of pages, this apparatus can shorten the total printing time.

The apparatus in Japanese Patent Laid-Open No. 2001-310833 includes a motor for driving a feeding roller, and a motor for driving a conveying roller and discharging roller. That is, this apparatus includes two roller driving sources. Since control of the feeding roller and control of the conveying roller and discharging roller can be performed by the separate driving sources, this has functional advantages such as skew correction and control of the feeding start timing. However, since the two driving sources are arranged, there is room for improvement in cost. If the number of driving sources can be decreased to one, this has an advantage in cost. In addition, if skew correction and control of the feeding start timing can be performed using one driving source, the functional advantages are also maintained in addition to the cost advantage.

SUMMARY OF THE INVENTION

The present invention provides a technique capable of controlling the feeding start timing while reducing the number of driving sources.

According to an aspect of the present invention, there is provided, for example, a printing apparatus comprising: a printing unit configured to print an image on a printing medium; a conveying unit arranged upstream of the printing unit in a conveyance direction of the printing medium, and configured to convey the printing medium; a driving source configured to drive the conveying unit; a feeding unit arranged upstream of the conveying unit in the conveyance direction and driven by a transmission of a driving of the driving source, and configured to feed the printing medium; a discharging unit arranged downstream of the printing unit in the conveyance direction and driven by a transmission of a driving of the driving source, and configured to discharge the printing medium; a control unit configured to start a feeding operation of a subsequent printing medium by the feeding unit before the discharging unit discharges a preceding printing medium; a switching mechanism configured to switch a driving state of the feeding unit between a feeding state and a non-feeding state; and a restricting mechanism configured to restrict backward feeding of the discharging unit, wherein in accordance with a printing start position of the subsequent printing medium, the control unit changes a timing to start the feeding operation of the subsequent printing medium.

According to another aspect of the present invention, there is provided, for example, a printing apparatus comprising: a printing unit configured to print an image on a printing medium; a conveying roller arranged upstream of the printing unit in a conveyance direction of the printing medium, and configured to convey the printing medium; a driving source configured to drive the conveying roller; a feeding roller arranged upstream of the conveying roller in the conveyance direction and driven by a transmission of a driving of the driving source, and configured to feed the printing medium; a discharging roller arranged downstream of the printing unit in the conveyance direction and driven by a transmission of a driving of the driving source, and configured to discharge the printing medium; a control unit configured to start a feeding operation of a subsequent printing medium by the feeding roller before the discharging roller discharges a preceding printing medium; and a switching mechanism configured to switch driving states of the feeding roller and the discharging roller, wherein in accordance with a printing start position of the subsequent printing medium, the control unit changes a timing to start the feeding operation of the subsequent printing medium, and when the feeding roller rotates in a forward direction in the conveyance direction, the switching mechanism does not transmit a driving of the driving source to the discharging roller, and when the discharging roller rotates in the forward direction in the conveyance direction, does not transmit a driving of the driving source to the feeding roller.

According to still another aspect of the present invention, there is provided, for example, a method of controlling a printing apparatus, the printing apparatus including: a printing unit configured to print an image on a printing medium; a conveying unit arranged upstream of the printing unit in a conveyance direction of the printing medium, and configured to convey the printing medium; a driving source configured to drive the conveying unit; a feeding unit arranged upstream of the conveying unit in the conveyance direction and driven by a transmission of a driving of the driving source, and configured to feed the printing medium; a discharging unit arranged downstream of the printing unit in the conveyance direction and driven by a transmission of a driving of the driving source, and configured to discharge the printing medium; a switching mechanism configured to switch a driving state of the feeding unit between a feeding state and a non-feeding state; and a restricting mechanism configured to restrict backward feeding of the discharging unit, the control method comprising the steps of: setting a feeding start timing by the feeding unit in accordance with a printing start position on a printing medium to be fed; and switching the driving state in accordance with the set feeding start timing.

According to still another aspect of the present invention, there is provided, for example, a method of controlling a printing apparatus, the printing apparatus including: a printing unit configured to print an image on a printing medium; a conveying roller arranged upstream of the printing unit in a conveyance direction of the printing medium, and configured to convey the printing medium; a driving source configured to drive the conveying roller; a feeding roller arranged upstream of the conveying roller in the conveyance direction and driven by a transmission of a driving of the driving source, and configured to feed the printing medium; a discharging roller arranged downstream of the printing unit in the conveyance direction and driven by a transmission of a driving of the driving source, and configured to discharge the printing medium; and a switching mechanism configured to switch driving states of the feeding roller and the discharging roller, wherein when the feeding roller rotates in a forward direction in the conveyance direction, the switching mechanism does not transmit a driving of the driving source to the discharging roller, and when the discharging roller rotates in the forward direction in the conveyance direction, does not transmit a driving of the driving source to the feeding roller, the control method comprising the steps of: setting a feeding start timing by the feeding roller in accordance with a printing start position on a printing medium to be fed; and switching the driving state in accordance with the set feeding start timing.

Further features of the present invention will become apparent from the following description of exemplary embodiments (with reference to the attached drawings).

DESCRIPTION OF THE EMBODIMENTS

Embodiments of the present invention will now be described. In this specification, the term "printing" (to be also referred to as "print") not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans.

Also, the term "printing medium" not only includes paper used in common printing apparatuses, but also broadly includes materials, such as cloth, a plastic film, a metal plate, glass, ceramics, wood, and leather, capable of accepting ink.

Furthermore, the term "ink" (to be also referred to as a "liquid") should be extensively interpreted similar to the definition of "printing (print)" described above. That is, "ink" includes a liquid which, when applied onto a printing medium, can form images, figures, patterns, and the like, can process the printing medium, or can process ink (for example, solidify or insolubilize a coloring agent contained in ink applied to the printing medium).

First Embodiment

Overall Arrangement

Figure 1:
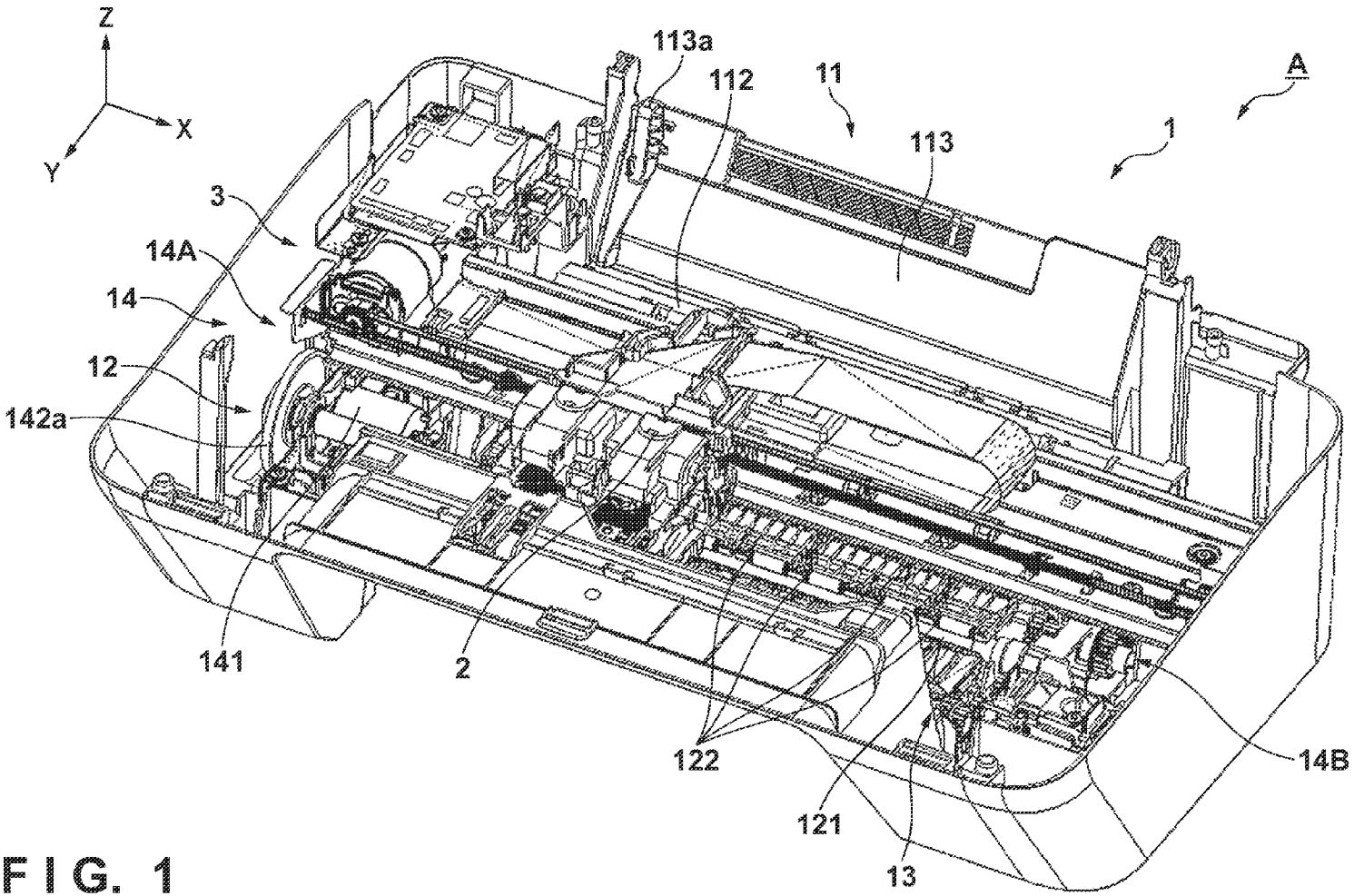
FIG. 1 is a schematic view showing a printing apparatus according to an embodiment of the present invention.
Figure 2:
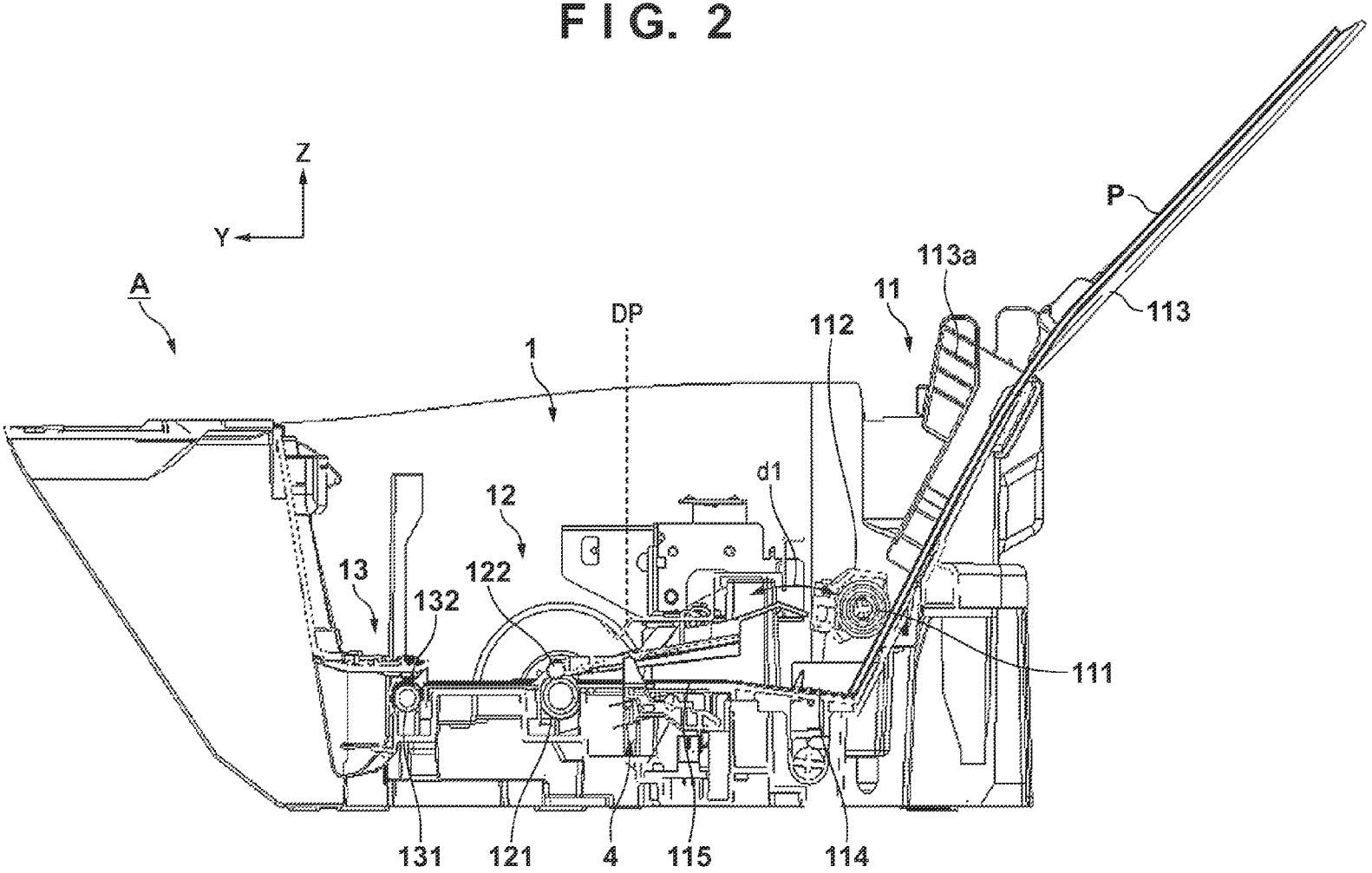
FIG. 2 is a view for explaining the inside of the printing apparatus in FIG. 1.

FIG. 1 is a schematic view showing a printing apparatus A according to an embodiment of the present invention. FIG. 2 is a view for explaining the inside of the printing apparatus A. In FIGS. 1 and 2, arrows X and Y indicate horizontal directions perpendicular to each other, and an arrow Z indicates a vertical direction. FIG. 1 shows a state in which the upper cover (not shown) of the printing apparatus A is removed. FIG. 2 is a cutaway view of the printing apparatus A, and mainly shows the layout of a conveying device 1.

The printing apparatus A is a serial inkjet printing apparatus, and includes the conveying device 1, a printing unit 2, a moving mechanism 3 for the printing unit 2, and a detection unit 4. The conveying device 1 conveys a sheet-like printing medium mainly in the Y direction serving as the conveyance direction (sub-scanning direction). The moving mechanism 3 reciprocates the printing unit 2 in the X direction (main scanning direction).

The conveying device 1 includes a feeding unit 11, a conveying unit 12, a discharging unit 13, and a driving mechanism 14 which drives them. The feeding unit 11 includes a feeding roller 111. The conveying unit 12 includes a conveying roller 121. The discharging unit 13 includes a discharging roller 131. These rollers parallelly extend in the X direction. These rollers are arranged in the order of the feeding roller 111, conveying roller 121, and discharging roller 131 from the upstream side to the downstream side in the printing medium conveyance direction (Y direction). The driving mechanism 14 is roughly divided into a driving mechanism 14A disposed on one end side of the conveying roller 121, and a driving mechanism 14B disposed on the other end side of the conveying roller 121.

<Feeding Unit>

Figure 3:
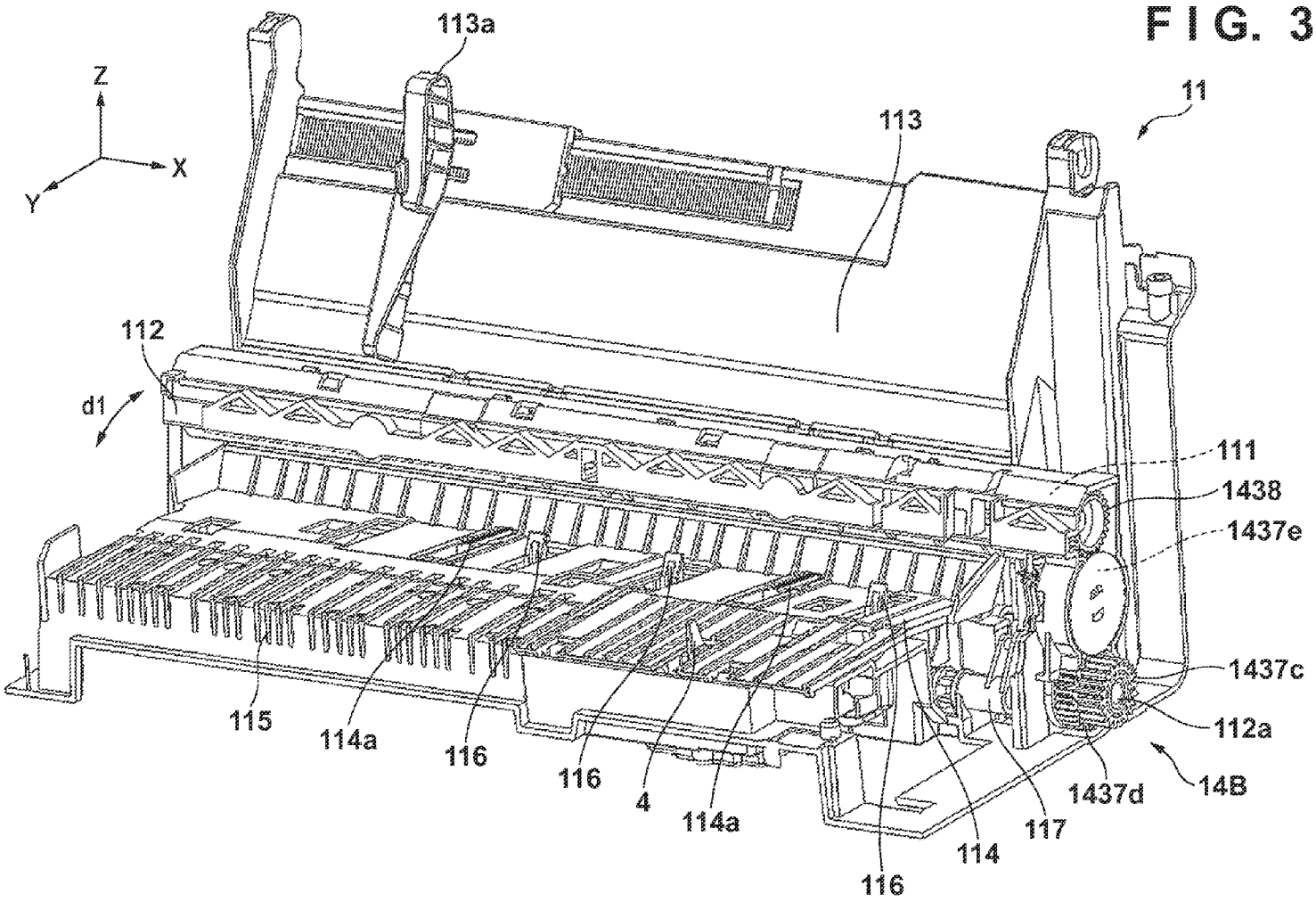
FIG. 3 is a view for explaining a feeding unit.

The feeding unit 11 will be explained with reference to FIGS. 1 to 3. FIG. 3 is a view for explaining the feeding unit 11. The feeding unit 11 includes an arm 112 which supports the feeding roller 111, a tray 113, an inclined surface portion 114, and a conveyance guide portion 115.

A plurality of printing media P are stacked on the tray 113. The tray 113 has a stacking surface which is inclined in the Z direction. The printing media P are stacked to lean against the stacking surface. The tray 113 includes a side surface guide 113*a*, and restricts the side edge position of a rectangular printing medium P.

The inclined surface portion 114 is formed at the bottom of the tray 113. The inclined surface portion 114 is made of a low-friction material to reduce the conveyance resistance of the printing medium P. Separating sections 114*a* against which the leading ends of the printing media P stacked on the tray 113 abut are arranged at two portions on the inclined surface portion 114. The separating sections 114*a* are arranged to separate the printing media P one by one. The surface of each separating section 114*a* is inclined at an obtuse angle in the conveyance direction of the printing medium P so as to easily separate one top printing medium P.

Three return arms 116 are disposed on the inclined surface portion 114. The return arms 116 are reciprocally arranged on the inclined surface portion 114 through openings formed in the inclined surface portion 114. An operating shaft 117 extending in the X direction is disposed below the inclined surface portion 114. The return arms 116 are coupled to the operating shaft 117 by links (not shown). The operating shaft 117 is driven by the driving mechanism 14B. At the time of the feeding operation of the printing medium P, the return arms 116 retreat below the inclined surface portion 114. At the time of the non-feeding operation, the return arms 116 project onto the inclined surface portion 114, and abut against the printing medium P stacked on the tray 113 to correct the orientation of the printing medium P remaining on the inclined surface portion 114.

The feeding roller 111 is rotatably supported by the arm 112 on one end side of the arm 112 in the Z direction. The arm 112 is supported by a shaft 112*a* on the other end side in the Z direction, and is pivotal about the shaft 112*a* serving as the pivot center in directions indicated by an arrow d1 (see FIGS. 2 and 3). The driving mechanism 14B can rotate the feeding roller 111 and pivot the arm 112, which will be described later.

The arm 112 pivots between a feeding position and a retreat position. In the feeding operation, the arm 112 pivots to the feeding position, and the feeding roller 111 abuts against the top printing medium P stacked on the tray 113. The retreat position is a position to which the feeding roller 111 is spaced apart from the tray 113.

In the feeding operation, the printing medium P is conveyed by the frictional force between the feeding roller 111 and the printing medium P by the rotation of the feeding roller 111. When the printing medium P passes the inclined surface portion 114, it is more reliably separated by the separating sections 114*a* from the second and subsequent printing media P on the tray 113. A horizontal conveyance guide portion 115 is formed downstream of the inclined surface portion 114 in the conveyance direction. The separated printing medium P is conveyed to the conveying roller 121 along the conveyance guide portion 115 by the conveyance force of the feeding roller 111.

<Detection Unit>

The detection unit 4 is arranged midway along the conveyance guide portion 115, and detects the arrival of the leading end of the printing medium P and the passage of its trailing end. The leading and trailing ends mean leading and trailing ends in the conveyance direction. As shown in FIG. 2, a detection position DP of the detection unit 4 is a position upstream of the conveying roller 121 in the conveyance direction and downstream of the feeding roller 111.

Figure 4A:
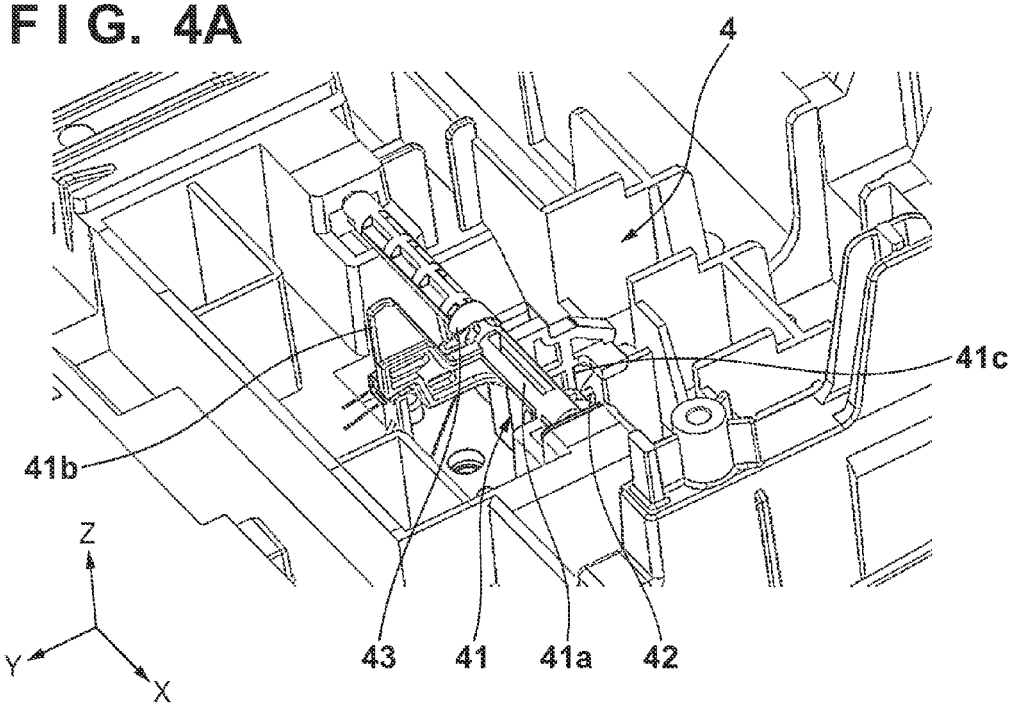
FIGS. 4A and 4B are views for explaining a detection unit.
Figure 4B:
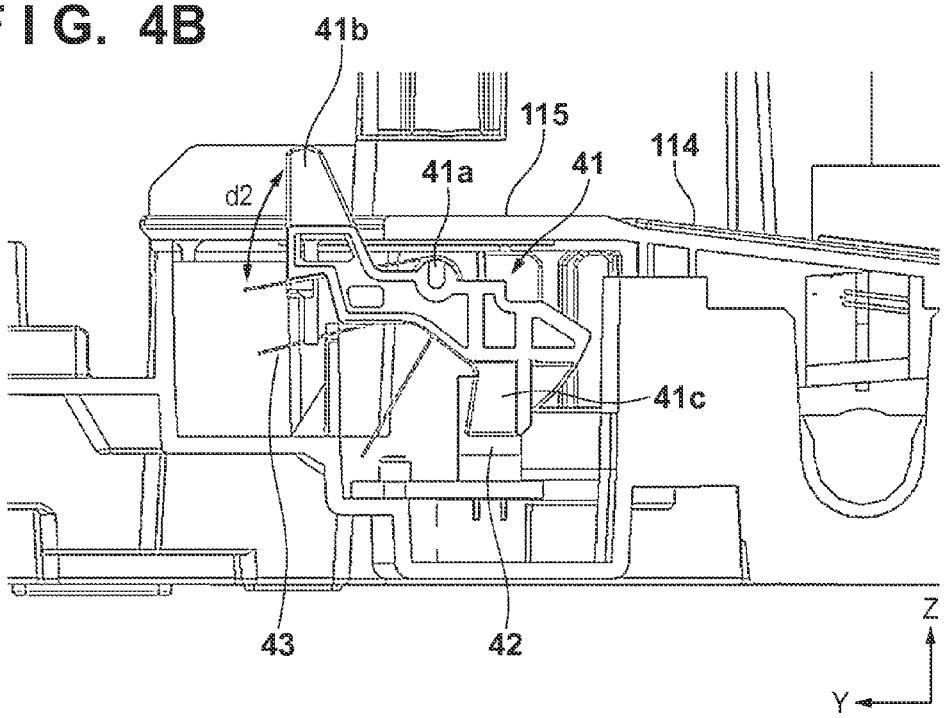

FIGS. 4A and 4B are views for explaining the detection unit 4. FIG. 4A shows a space below the conveyance guide portion 115, and is a perspective view showing the detection unit 4. FIG. 4B is a view showing the disposing portion of the detection unit 4 when viewed from the X direction.

The detection unit 4 includes a sensor lever 41, sensor 42, and elastic member 43. The sensor lever 41 includes a shaft portion 41*a* extending in the X direction. The entire sensor lever 41 is pivotal about the shaft portion 41*a* serving as the pivot center in directions indicated by an arrow d2 in FIG. 4B. The sensor lever 41 also includes an abutment portion 41*b* which abuts against the printing medium P, and a portion 41*c* to be detected.

The abutment portion 41*b* is formed to project onto the conveyance guide portion 115 through a slit formed in the conveyance guide portion 115. The portion 41*c* to be detected is a portion, the presence of which is detected by the sensor 42 when the sensor lever 41 is in an initial orientation. The sensor 42 is a photosensor.

In the embodiment, the elastic member 43 is a coil-like spring wound around the shaft portion 41*a*. One end portion of the elastic member 43 is locked to the sensor lever 41, and the other end portion is locked to the housing of the printing apparatus A. The elastic member 43 biases the sensor lever 41 in one direction, and the abutment portion 41*b* projects onto the conveyance guide portion 115.

When the printing medium P is conveyed on the conveyance guide portion 115, the leading end of the printing medium P abuts against the abutment portion 41*b*, the sensor lever 41 pivots against the biasing force of the elastic member 43, and the abutment portion 41*b* moves below the conveyance guide portion 115. At this time, the portion 41*c* to be detected moves apart from the sensor 42, and the sensor 42 does not detect the portion 41*c* to be detected any more. From this, it is detected that the leading end of the printing medium P has arrived at the detection position DP. This state continues while the printing medium P passes on the abutment portion 41*b*.

When the trailing end of the printing medium P passes on the abutment portion 41*b*, the sensor lever 41 pivots by the biasing force of the elastic member 43 and returns to the initial orientation. At this time, the sensor 42 detects the portion 41*c* to be detected. As a result, it is detected that the trailing end of the printing medium P has passed the detection position DP. Note that an example of the arrangement of the detection unit 4 is not limited to this, and the arrangement is arbitrary as long as the arrival of the leading end of the printing medium P and the passage of its trailing end can be detected.

<Conveying Unit>

Figure 5:
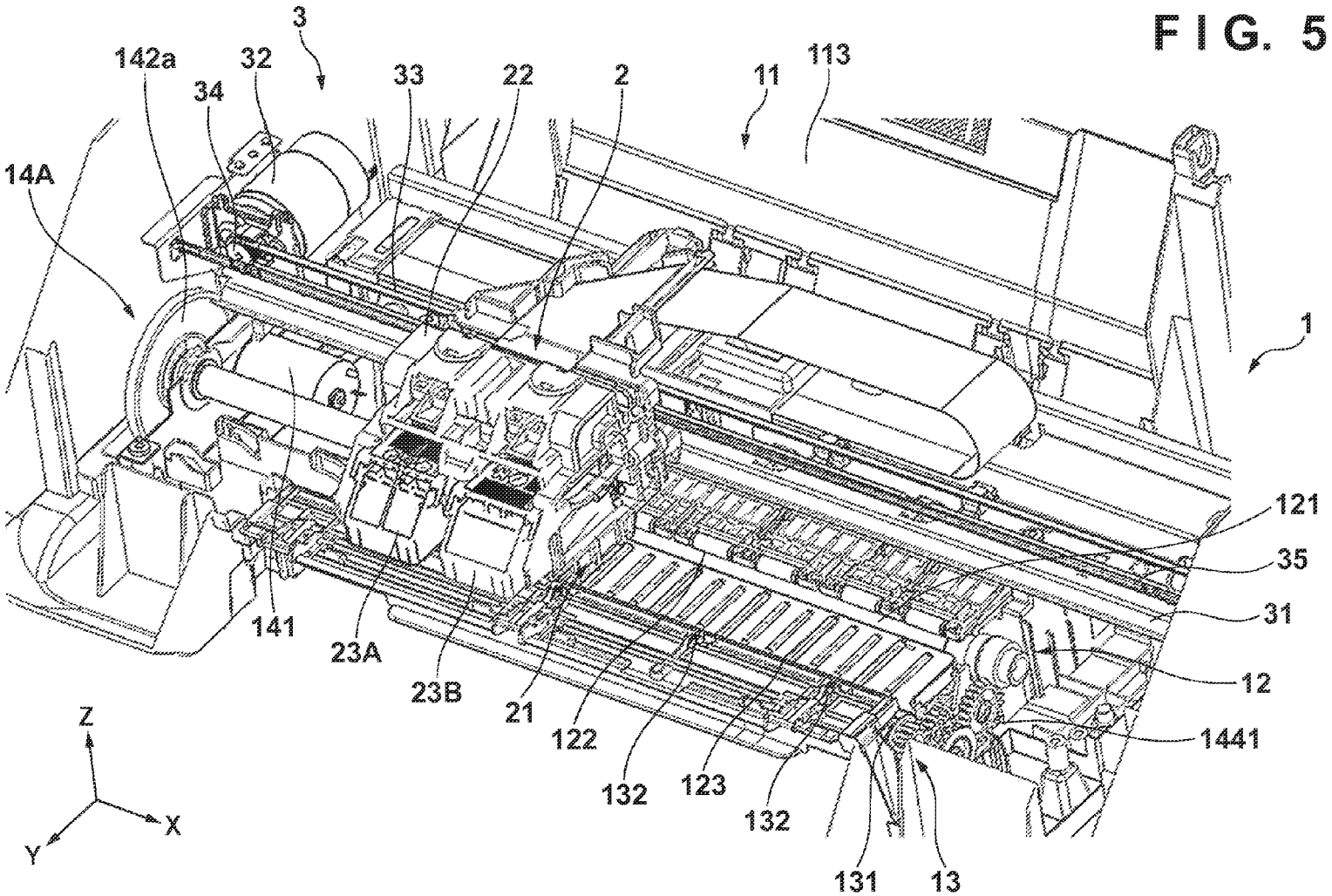
FIG. 5 is a view for explaining a conveying unit, discharging unit, printing unit, and moving mechanism.
Figure 6:
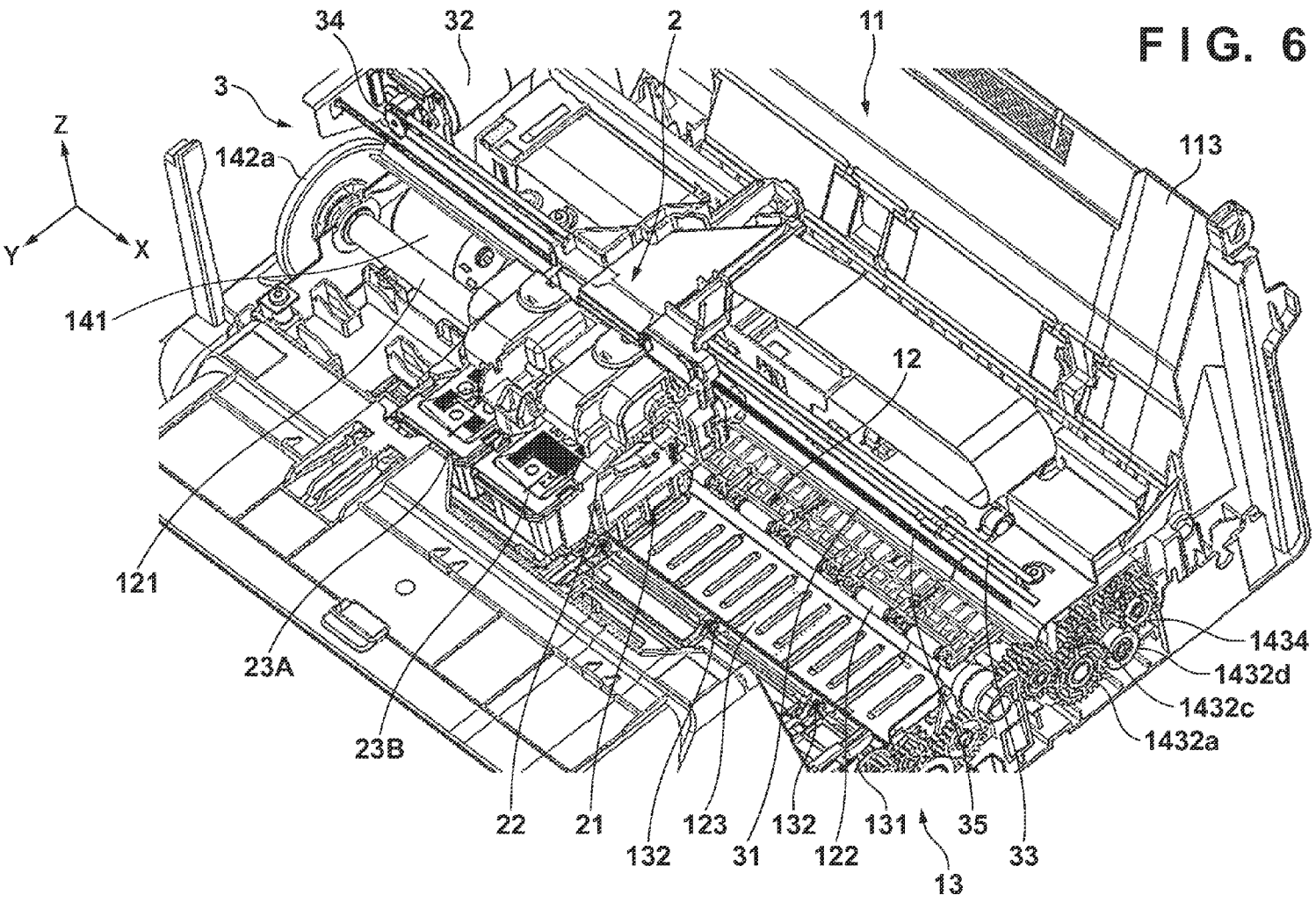
FIG. 6 is a view for explaining the conveying unit, discharging unit, printing unit, and moving mechanism.

The conveying unit 12 will be explained with reference to FIGS. 1, 2, 5, and 6. FIGS. 5 and 6 are views for explaining the conveying unit 12, discharging unit 13, printing unit 2, and moving mechanism 3.

The conveying unit 12 includes the conveying roller 121 and a plurality of pinch rollers 122. The pinch rollers 122 press-contact the conveying roller 121 by the biasing force of an elastic member (for example, spring: not shown), and rotate following the rotation of the conveying roller 121. The conveying roller 121 and pinch rollers 122 rotate to convey the printing medium P while pinching the printing medium P at nip portions between them. Of rotational directions of the conveying roller 121, a direction in which the printing medium P is fed in a forward direction will be called a forward rotational direction, and a direction in which the printing medium P is fed in a backward direction will be called a backward rotational direction. This also applies to the remaining rollers.

The conveying unit 12 mainly performs conveyance of the printing medium P in the sub-scanning direction during the printing operation by the printing unit 2, and conveys the printing medium P to the discharging unit 13. The printing medium P is conveyed between the printing unit 2 and a platen 123 while it is maintained in a horizontal orientation on the platen 123.

At the time of the feeding operation of the printing medium P by the feeding unit 11, skew correction of the printing medium P can be performed by abutting the leading end of the printing medium P against the nip portions between the conveying roller 121 and the pinch rollers 122. During skew correction, the conveying roller 121 rotates in the backward direction in the embodiment, but the rotation may be stopped.

<Printing Unit and Moving Mechanism>

The printing unit 2 and moving mechanism 3 will be explained with reference to FIGS. 1, 5, and 6. The printing unit 2 includes a printhead 21, a carriage 22 which supports the printhead 21, and cartridges 23A and 23B mounted on the carriage 22. The cartridges 23A and 23B store inks to be supplied to the printhead 21. The printhead 21 includes a plurality of nozzles for discharging ink, and forms an image on the printing medium P by discharging ink. The image printing position is a position downstream of the conveying roller 121 in the conveyance direction and upstream of the discharging roller 131 in the conveyance direction.

The moving mechanism 3 includes a guide rail 31, carriage motor 32, and carriage belt 33. The guide rail 31 extends in the main scanning direction, and guides movement of the carriage 22 in the main scanning direction. The carriage belt 33 is looped between a driving pulley 34 rotated by the carriage motor 32, and a driven pulley (not shown) arranged on a side opposite to the driving pulley 34 in the main scanning direction. The carriage belt 33 moves in the main scanning direction. The carriage 22 is coupled to part of the carriage belt 33, and moves in the printing region in the main scanning direction along with movement of the carriage belt 33.

The position and speed of the carriage 22 are detected by reading an encoder scale 35 by an encoder sensor (not shown) mounted on the carriage 22. The encoder scale 35 extends in the main scanning direction.

An image is printed on the printing medium P by repeating the printing operation of the printhead 21 that is performed in synchronism with movement (main scanning) of the carriage 22, and conveyance (sub-scanning) of the printing medium P at every predetermined pitch that is performed by the conveying unit 12 and driving mechanism 14.

<Discharging Unit>

The discharging unit 13 will be explained with reference to FIGS. 1, 2, 5, and 6. The discharging unit 13 includes the discharging roller 131, and a plurality of spurs 132 which face the discharging roller 131 and form nip portions. The spurs 132 rotate following the rotation of the discharging roller 131, and convey the printing medium P downstream in the sub-scanning direction along with forward rotation of the discharging roller 131. The discharging unit 13 mainly conveys the printing medium P conveyed from the conveying unit 12, and discharges it outside.

<Driving Mechanism>

Next, the driving mechanism 14 will be described. First, the driving mechanism 14A will be explained with reference to FIGS. 5 and 6.

The driving mechanism 14A includes a conveyance motor (driving source) 141 and gear 142*a*. The conveyance motor 141 is a single driving source common to the feeding unit 11, conveying unit 12, and discharging unit 13, and is a motor in the embodiment. The gear 142*a* is coaxially coupled to one end of the conveying roller 121. A gear 142*a* is meshed with a pinion gear (not shown) fixed to the output shaft of the conveyance motor 141. The conveyance motor 141 drives the conveying roller 121 to rotate, and the conveying roller 121 rotates in the forward or backward direction in accordance with the rotational direction of the conveyance motor 141.

Figure 7:
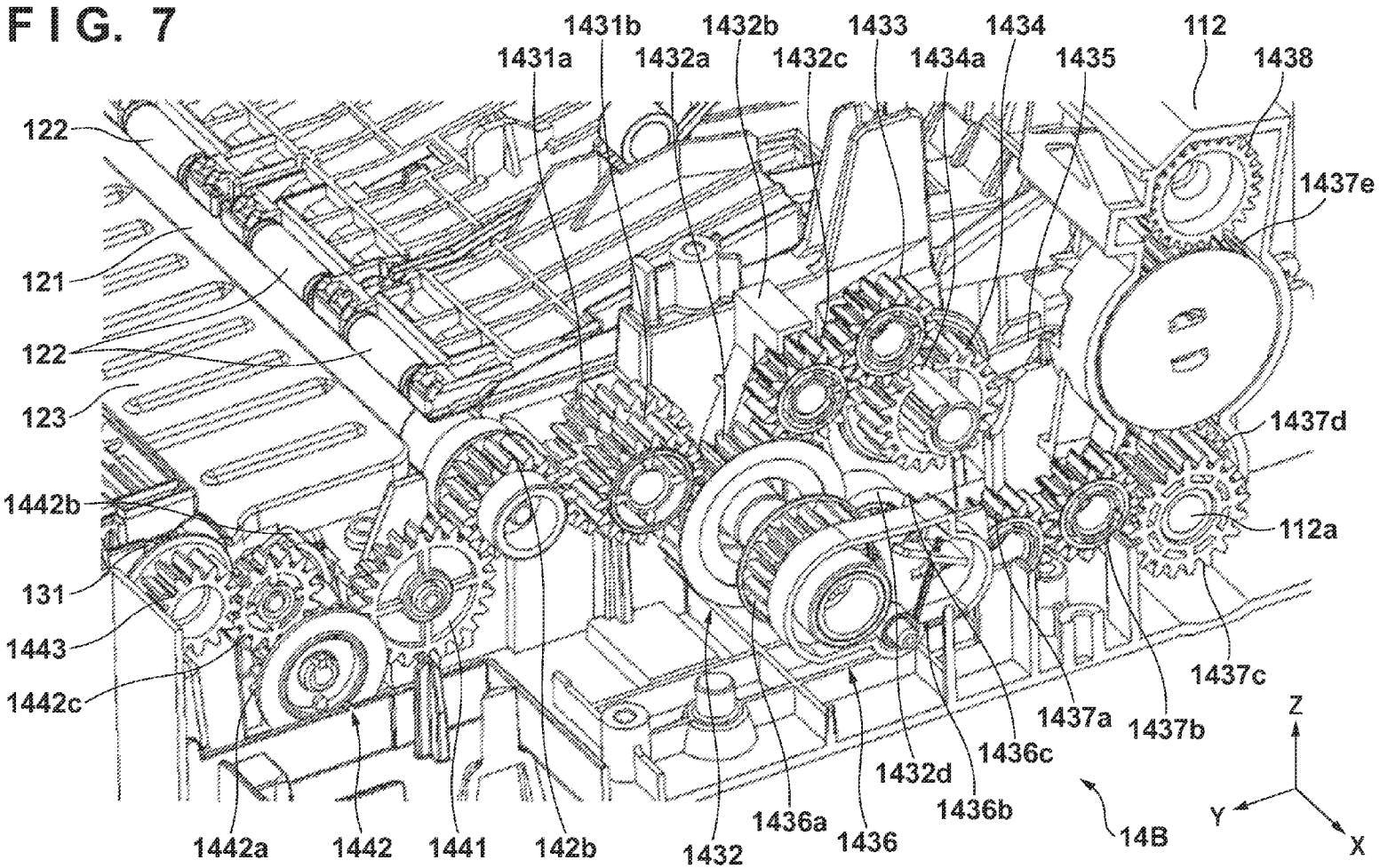
FIG. 7 is a view for explaining a driving mechanism.
Figure 8:
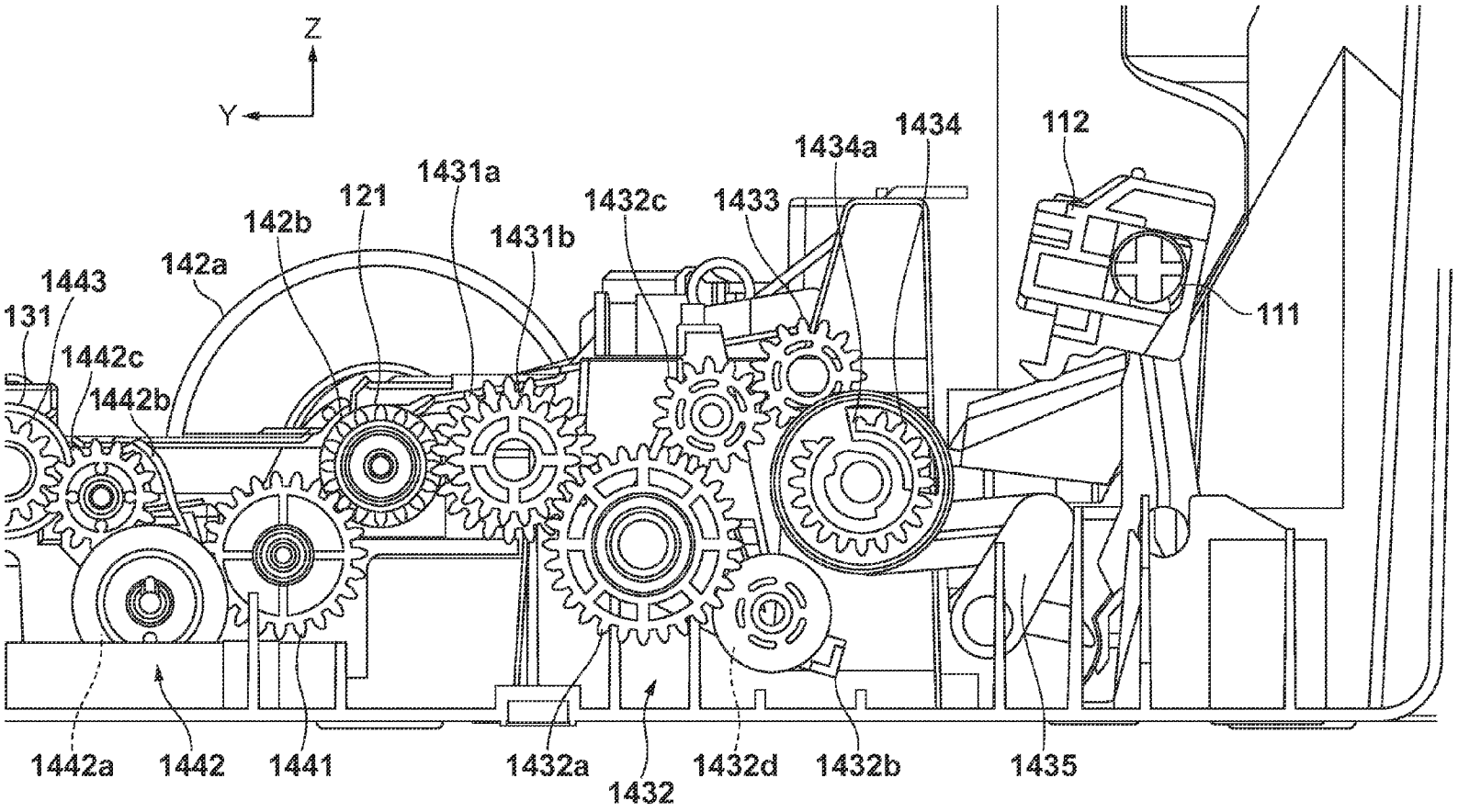
FIG. 8 is a view for explaining the driving mechanism.

Next, the driving mechanism 14B will be explained with reference to FIGS. 7 and 8. FIGS. 7 and 8 are views for explaining the driving mechanism 14B. FIG. 7 is a partially cutaway perspective view. FIG. 8 is a sectional view taken along, as a cutting plane, a mechanical portion regarding the pivot of the arm 112.

The driving mechanism 14B includes a gear 142*b* coaxially coupled to the other end of the conveying roller 121. The driving force of the conveyance motor 141 is transmitted from the gear 142*b* serving as the starting point to the feeding unit 11 and discharging unit 13.

First, a driving force transmission mechanism to the feeding unit 11 will be explained. The driving force transmission mechanism to the feeding unit 11 includes a gear 1431*a* which is always meshed with the gear 142*b*, and a gear 1431*b* which coaxially rotates together with the gear 1431*a*. The gears 1431*a* and 1431*b* are idle gears. The driving force transmission mechanism of the feeding unit 11 is roughly divided into a mechanism which rotates the feeding roller 111, and a mechanism which pivots the arm 112.

The mechanism which pivots the arm 112 includes a switching mechanism 1432, gears 1433 and 1434, and a control link 1435.

The switching mechanism 1432 can switch the driving state of the feeding unit 11 between a feeding enable state and a feeding disable state by pivoting the arm 112 between the feeding position and the retreat position. In the embodiment, the switching mechanism 1432 is a planet gear mechanism, and includes a sun gear 1432*a*, a carrier 1432*b*, and two planet gears 1432*c* and 1432*d*.

The sun gear 1432*a* is always meshed with the gear 1431*b*. The carrier 1432*b* is pivotally supported by the sun gear 1432*a* coaxially. The two planet gears 1432*c* and 1432*d* are pivotally supported by the carrier 1432*b*, and always meshed with the sun gear 1432*a*. The two planet gears 1432*c* and 1432*d* are supported by the carrier 1432*b* at positions spaced apart from each other, and are not meshed with each other.

The gear 1433 is an idle gear which is meshed with the planet gear 1432*c* in accordance with the pivot position of the carrier 1432*b*. The gear 1434 is meshed with the gear 1433, and also meshed with the planet gear 1432*d* in accordance with the pivot position of the carrier 1432*b*. The control link 1435 which pivots the arm 112 is coupled to the gear 1434 at a position decentered from the rotation center of the gear 1434. The control link 1435 pivots the arm 112 in accordance with the rotation amount of the gear 1434.

The gear 1434 includes a toothless portion 1434*a*. When the meshed portion of the gear 1434 with the gear 1433 or planet gear 1432*d* reaches the portion 1434*a*, the mesh of their teeth is disengaged to cut the driving transmission. Accordingly, the pivot range of the arm 112 can be restricted to pivot the arm 112 between the feeding position and the retreat position. By intervening an elastic member (not shown) between the arm 112 and the control link 1435, the arm 112 and feeding roller 111 can be located at positions corresponding to the stacking amount of the printing media P when moving the arm 112 to the feeding position.

The mechanism which rotates the feeding roller 111 includes a switching mechanism 1436, gears 1437*a* to 1437*e*, and a gear 1438 which is coaxially coupled to one end of the feeding roller 111.

The switching mechanism 1436 switches the driving state of the feeding unit 11 between a conveyance enable state and a conveyance disable state by intermittently transmitting the driving force to the gear 1438. In the embodiment, the switching mechanism 1436 is a planet gear mechanism, and includes a sun gear 1436*a*, carrier 1436*b*, and planet gear 1436*c*.

The sun gear 1436*a* coaxially rotates together with the sun gear 1432*a*. The carrier 1436*b* is pivotally supported by the sun gear 1436*a* coaxially. The planet gear 1436*c* is rotatably supported by the carrier 1436*b*, and always meshed with the sun gear 1436*a*.

The gear 1437*a* is an idle gear which is meshed with the planet gear 1436*c* in accordance with the pivot position of the carrier 1436*b*. The gear 1437*b* is an idle gear which is always meshed with the gear 1437*a*. The gear 1437*c* is an idle gear which is always meshed with the gear 1437*b*, and rotatably supported by the shaft 112*a* serving as the pivot center of the arm 112. The gear 1437*d* is an idle gear which is rotatably supported by the shaft 112*a* serving as the pivot center of the arm 112, and rotates together with the gear 1437*c*. The gear 1437*e* is an idle gear which is rotatably supported by the arm 112, and always meshed with the gears 1437*d* and 1438.

In a state in which the planet gear 1436*c* is meshed with the gear 1437*a*, the driving force of the conveyance motor 141 is transmitted to the gear 1438 to rotate the feeding roller 111 in the forward direction. By the pivot of the carrier 1432*b*, in a state in which the planet gear 1436*c* is not meshed with the gear 1437*a*, the transmission of the driving force is cut at this portion, and the feeding roller 111 stops.

Next, a driving force transmission mechanism to the discharging unit 13 will be explained. The driving force transmission mechanism to the discharging unit 13 includes a gear 1441 which is always meshed with the gear 142*b*, a switching mechanism 1442, and a gear 1443 which is coaxially coupled to one end of the discharging roller 131.

The switching mechanism 1442 switches the driving state of the discharging unit 13 between a discharge enable state and a discharge disable state by intermittently transmitting the driving force to the gear 1443. In the embodiment, the switching mechanism 1442 is a planet gear mechanism, and includes a sun gear 1442*a*, carrier 1442*b*, and planet gear 1442*c*.

The sun gear 1442*a* is always meshed with a gear 1441. The carrier 1442*b* is pivotally supported by the sun gear 1442*a* coaxially. The planet gear 1442*c* is pivotally supported by the carrier 1442*b*, and always meshed with the sun gear 1442*a*.

The gear 1443 is meshed with the planet gear 1442*c* in accordance with the pivot position of the carrier 1442*b*. In a state in which a planet gear 1442*c* is meshed with the gear 1443, the driving force of the conveyance motor 141 is transmitted to the gear 1443 to rotate the discharging roller 131 in the forward direction. By the pivot of the carrier 1442*b*, in a state in which the planet gear 1442*c* is not meshed with the gear 1443, the transmission of the driving force is cut at this portion, and the discharging roller 131 stops.

<Switching of Driving State>

Figure 9:
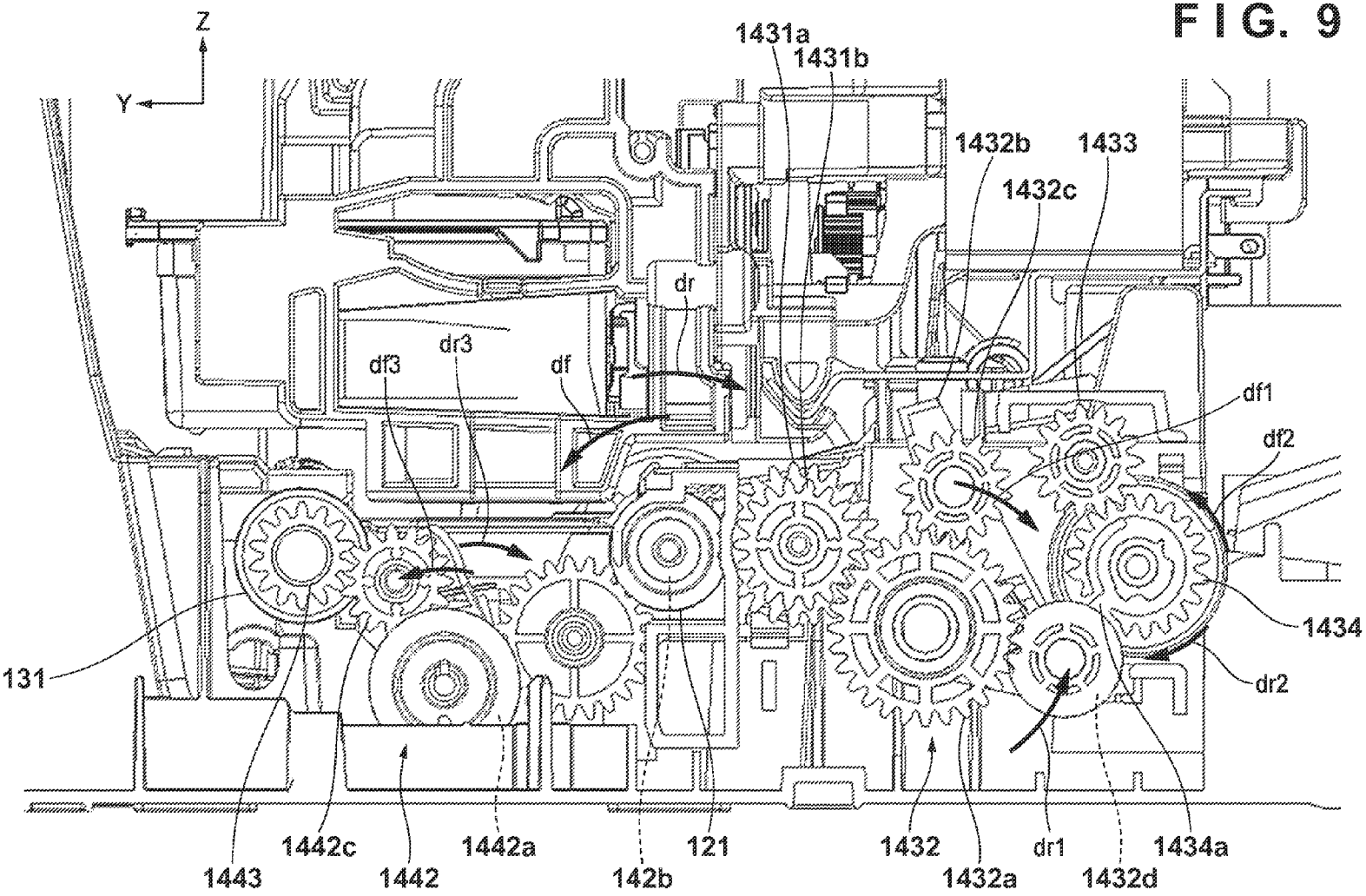
FIG. 9 is a view for explaining the driving mechanism.
Figure 10:
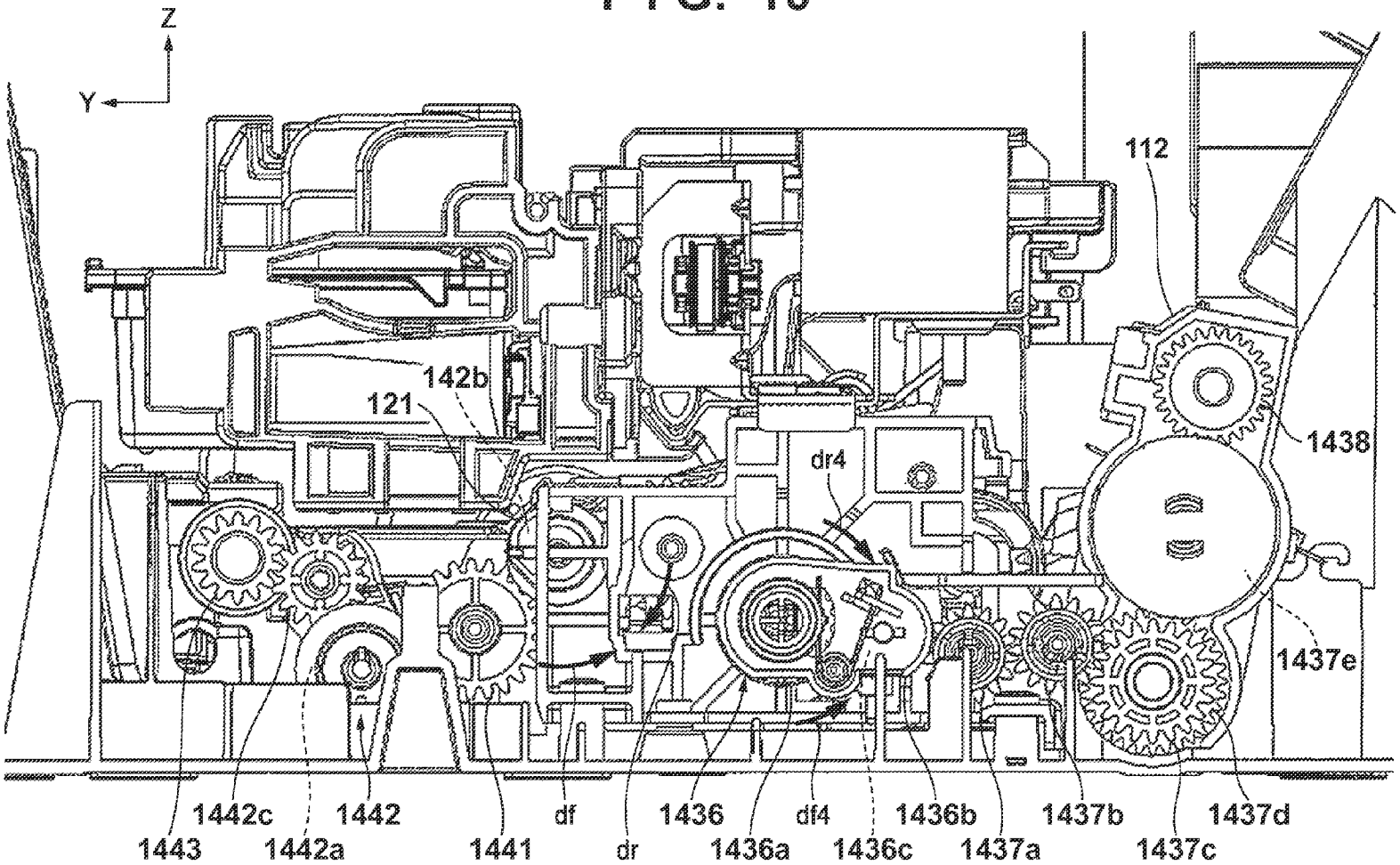
FIG. 10 is a view for explaining the driving mechanism.

Next, switching of the driving states of the feeding unit 11 and discharging unit 13 in accordance with the rotational direction of the conveying roller 121 will be explained with reference to FIGS. 9 and 10. FIGS. 9 and 10 are views for explaining the driving mechanism 14B. FIG. 9 shows the rotational direction of the conveying roller 121, and the relationship between the switching mechanisms 1432 and 1442. FIG. 10 shows the rotational direction of the conveying roller 121, and the relationship with the switching mechanism 1436. In FIGS. 9 and 10, arrows df and dr indicate the forward rotational direction and backward rotational direction, respectively, of the conveying roller 121.

As already described above, in the embodiment, the switching mechanism 1432 is arranged in a driving force transmission path between the conveyance motor 141 and the arm 112, and switches the position of the arm 112. The switching mechanism 1436 is arranged in a driving force transmission path between the conveyance motor 141 and the feeding roller 111, and switches the feeding roller 111 between rotation and stop. The switching mechanism 1442 is arranged in a driving force transmission path between the conveyance motor 141 and the discharging roller 131, and switches the discharging roller 131 between rotation and stop.

First, a case in which the conveying roller 121 rotates in the backward direction will be explained. Referring to FIG. 9, when the conveying roller 121 rotates in the backward direction, the carrier 1432*b* of the switching mechanism 1432 pivots in a direction indicated by an arrow dr1, and the planet gear 1432*d* and gear 1434 are meshed with each other. In contrast, the planet gear 1432*c* moves apart from the gear 1433 and is not meshed with it any more.

The driving force of the conveyance motor 141 is transmitted to the gear 1434 via the planet gear 1432*d* to rotate the gear 1434 in a direction indicated by an arrow dr2. By the rotation of the gear 1434, the arm 112 pivots to the feeding position via the control link 1435, and the feeding roller 111 comes into contact with the top printing medium P on the tray 113. The rotation of the gear 1434 ends when the mesh position of the planet gear 1432*d* and gear 1434 reaches the portion 1434*a*, and the pivot of the arm 112 also stops. At this time, the position of the control link 1435 can be locked by an engaging mechanism (not shown).

Referring to FIG. 10, when the conveying roller 121 rotates in the backward direction, the carrier 1436*b* of the switching mechanism 1436 pivots in a direction indicated by an arrow dr4, and the planet gear 1436*c* and gear 1437*a* are meshed with each other. The driving force of the conveyance motor 141 is transmitted to the gear 1437*a* via the planet gear 1436*c* to rotate the gear 1438. In response to this, the feeding roller 111 rotates in the forward direction, and the top printing medium P on the tray 113 is fed toward the conveying roller 121. When the printing medium P arrives at the conveying roller 121, the conveying roller 121 is being rotated in the backward direction. The leading end of the printing medium P abuts against the nip portions between a pair of conveying rollers during backward rotation, and skew correction is performed.

Referring to FIG. 9, when the conveying roller 121 rotates in the backward direction, the carrier 1442*b* of the switching mechanism 1442 pivots in a direction indicated by an arrow dr3, and the planet gear 1442*c* moves apart from the gear 1443 and is not meshed with it any more. The driving force of the conveyance motor 141 is not transmitted to the gear 1443, and the discharging roller 131 stops. As a result, backward rotation of the discharging roller 131 is restricted. That is, the switching mechanism 1442 functions as a restricting mechanism of restricting backward rotation of the discharging roller 131 in the conveyance direction.

Next, a case in which the conveying roller 121 rotates in the forward direction will be explained. Referring to FIG. 9, when the conveying roller 121 rotates in the forward direction, the carrier 1432*b* of the switching mechanism 1432 pivots in a direction indicated by an arrow df1, and the planet gear 1432*c* and gear 1433 are meshed with each other. In contrast, the planet gear 1432*d* moves apart from the gear 1434 and is not meshed with it any more.

The driving force of the conveyance motor 141 is transmitted to the gear 1434 via the planet gear 1432*c* and gear 1433 to rotate the gear 1434 in a direction indicated by an arrow df2. By the rotation of the gear 1434, the arm 112 pivots to the retreat position via the control link 1435, and the feeding roller 111 moves apart from the printing medium P on the tray 113. The rotation of the gear 1434 ends when the mesh position of the gears 1433 and 1434 reaches the portion 1434*a*, and the pivot of the arm 112 also stops. At this time, the position of the control link 1435 can be locked by the engaging mechanism (not shown).

Referring to FIG. 10, when the conveying roller 121 rotates in the forward direction, the carrier 1436*b* of the switching mechanism 1436 pivots in a direction indicated by an arrow df3, and the planet gear 1436*c* moves apart from the gear 1437*a* and is not meshed with it any more. The driving force of the conveyance motor 141 is not transmitted to the gear 1437*a*, and thus the feeding roller 111 stops.

Referring to FIG. 9, when the conveying roller 121 rotates in the forward direction, the carrier 1442*b* of the switching mechanism 1442 pivots in a direction indicated by an arrow df4, and the planet gear 1442*c* is meshed with the gear 1443. The driving force of the conveyance motor 141 is transmitted to the gear 1443 via the planet gear 1442*c* to rotate the discharging roller 131 in the forward direction. Accordingly, both the conveying roller 121 and discharging roller 131 rotate in the forward direction to convey the printing medium P to the printing unit 2 and print an image. After printing the image, the printing medium P is discharged.

Switching of the driving state is summarized as follows:

When the conveying roller 121 rotates in the backward direction the feeding unit 11 (feeding state):

the arm 112 pivots to the feeding position and the feeding roller 111 rotates in the forward direction the discharging unit 13:

the discharging roller 131 stops

When the conveying roller 121 rotates in the forward direction the feeding unit 11 (non-feeding state):

the arm 112 pivots to the retreat position and the feeding roller 111 stops the discharging unit 13:

the discharging roller 131 rotates in the forward direction

From this, the operation of one unit of image printing on one printing medium P is achieved by, for example, first rotating the conveying roller 121 in the backward direction to perform the feeding operation and skew correcting operation of the printing medium P, and then rotating the conveying roller 121 in the forward direction to perform the conveyance operation and discharge operation of the printing medium P.

<Control Unit>

Figure 11:
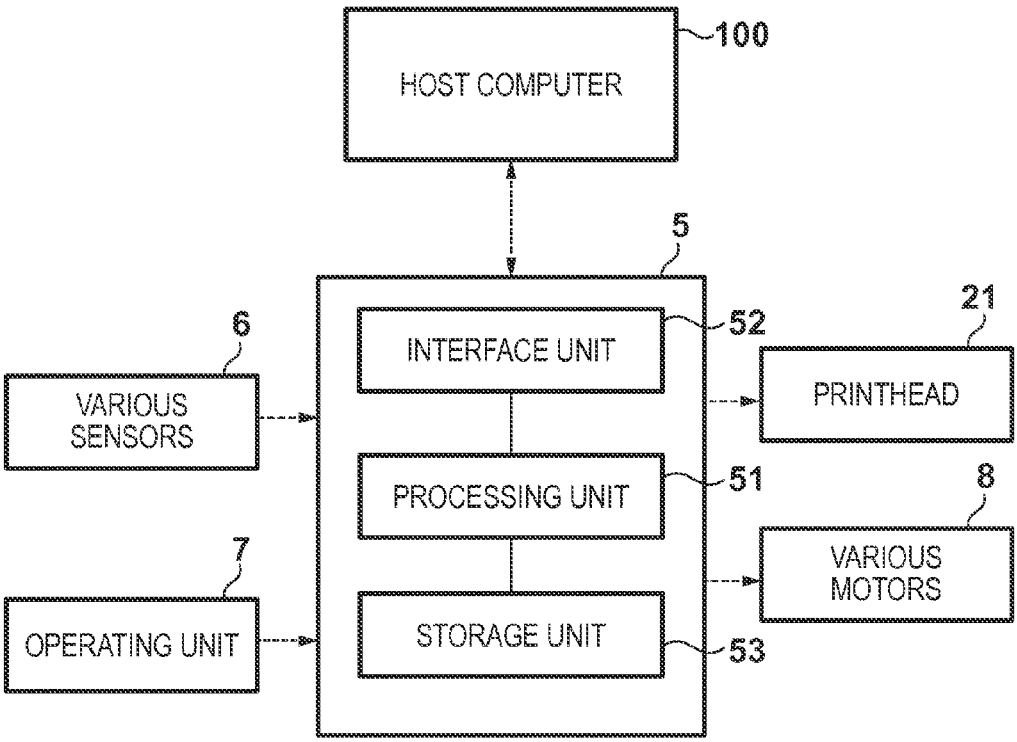
FIG. 11 is a block diagram showing a control system.

FIG. 11 is a block diagram showing the control system of the printing apparatus A. The printing apparatus A includes a control unit 5. The control unit 5 includes a processing unit 51 such as a CPU, an interface unit 52 which exchanges data with an external device, and a storage unit 53 such as a ROM or RAM. The processing unit 51 loads and executes a program stored in the storage unit 53.

Arithmetic processing to be performed by the processing unit 51 includes, for example, image processing, communication processing with a host computer 100 via the interface unit 52, and acceptance processing for information input by the user via an operating unit 7. The operating unit 7 is, for example, an operation panel arranged on the printing apparatus A, and the user can input information such as the type of printing paper.

Arithmetic processing to be performed by the processing unit 51 also includes, for example, discharge control of the printhead 21 and driving control of various motors 8 which are performed based on the detection results of various sensors 6. The sensors 6 include the above-mentioned encoder sensor, the sensor 42 of the detection unit 4, and a sensor which detects the rotation amount of the conveyance motor 141. The motors 8 include the carriage motor 32 and conveyance motor 141.

The storage unit 53 stores, for example, a control program for controlling the printing apparatus A, data necessary to execute the control program, and the like. The storage unit 53 may also save, for example, printing data transmitted from the host computer 100.

<Example of Control>

Figure 12:
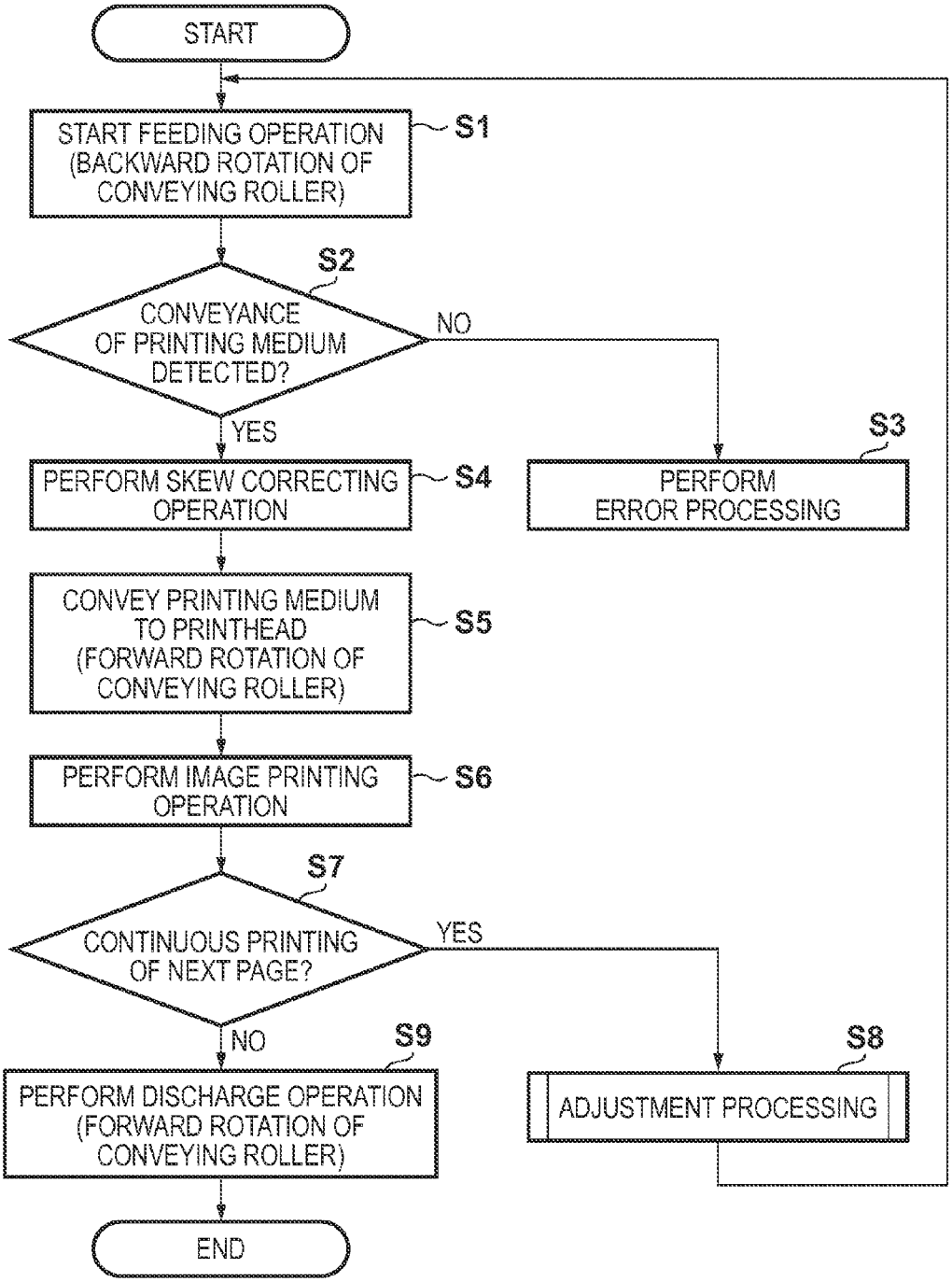
FIG. 12 is a flowchart showing an example of processing by a control unit in FIG. 10.

An example of control to be executed by the control unit 5 will be explained. FIG. 12 is a flowchart showing an example of processing to be executed by the processing unit 51 of the control unit 5. When the host computer 100 or the like transmits a printing instruction, the feeding operation starts (step S1). In the embodiment, as already described above, the feeding operation starts by rotating the conveyance motor 141 in the backward direction. In response to this, the arm 112 pivots to the feeding position, and the feeding roller 111 rotates in the forward direction to feed the top printing medium P among the printing media P stacked on the tray 113.

During the feeding operation of the printing medium P, the detection result of the detection unit 4 is monitored to determine whether the detection unit 4 has detected the arrival of the leading end of the printing medium P (step S2). If the arrival has been detected, the process advances to step S4. If the detection unit 4 has not detected the arrival of the leading end of the printing medium P though the rotation amount of the conveyance motor 141 has reached a predetermined amount, error processing is performed (step S3). For example, a notification (display or voice) representing a feeding error is made to prompt the user to, for example, confirm the printing medium P. If the user performs a predetermined operation on the operating unit 7, the process returns to step S1 to perform the feeding operation again.

In step S4, the skew correcting operation (registration adjustment) is performed. After the leading end of the printing medium P is detected in step S2, it is controlled to convey the printing medium P by a predetermined conveyance amount and abut the leading end of the printing medium P against the nip portions between the conveying roller 121 and the pinch rollers 122. Since the conveying roller 121 is being rotated in the backward direction, the printing medium P does not enter the nip portions, and if the printing medium P is skewed, the skew is corrected.

In step S5, the rotational direction of the conveying roller 121 is switched to the forward rotational direction, and the printing medium P is conveyed to the start position of image printing by the printhead 21. Subsequently, an image is printed on the printing medium P (step S6). In this image printing operation, an image is printed by the cooperative operation of the printing unit 2, moving mechanism 3, conveying unit 12, and discharging unit 13. After the end of the image printing operation, the process advances to step S7.

In step S7, it is determined whether the current printing instruction is to perform the printing operation continuously for a plurality of pages. For example, it is determined whether an image file subjected to the printing instruction requires printing of images on the printing media P of a plurality of pages, or whether there is an unprinted page. If YES in step S7, the process advances to step S8. If NO in step S7 (for example, if the printing instruction designates printing of one printing medium or printing of the final page has ended), the process advances to step S9.

In step S8, adjustment processing is executed, details of which will be described later. In step S9, the discharge operation is performed. At this time, the rotational direction of the conveying roller 121 is maintained in the forward rotational direction, and the printing medium P having undergone printing is conveyed until it is discharged from the apparatus. As a result, processing of one unit ends.

Figure 13A:
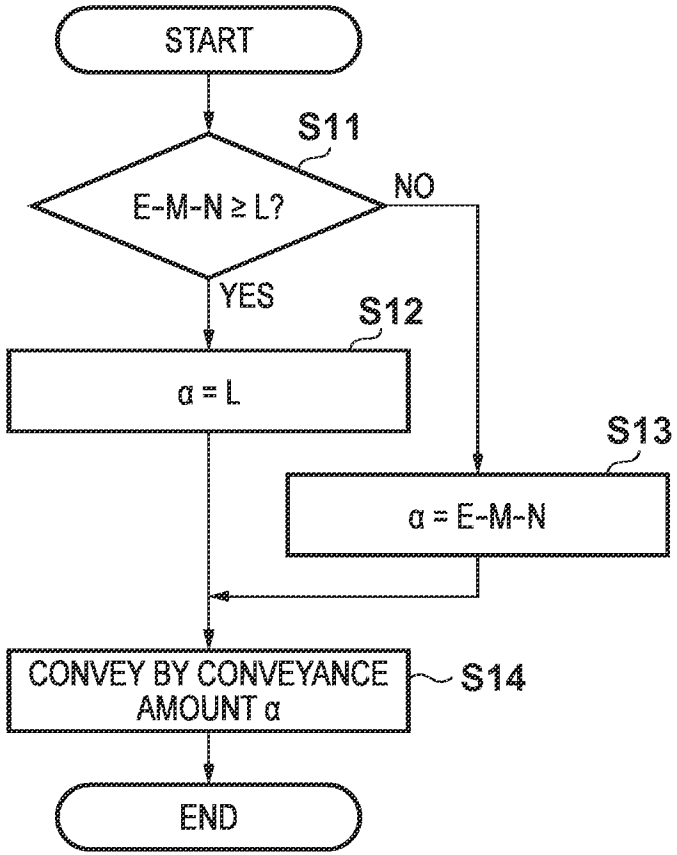
Figure 14A:
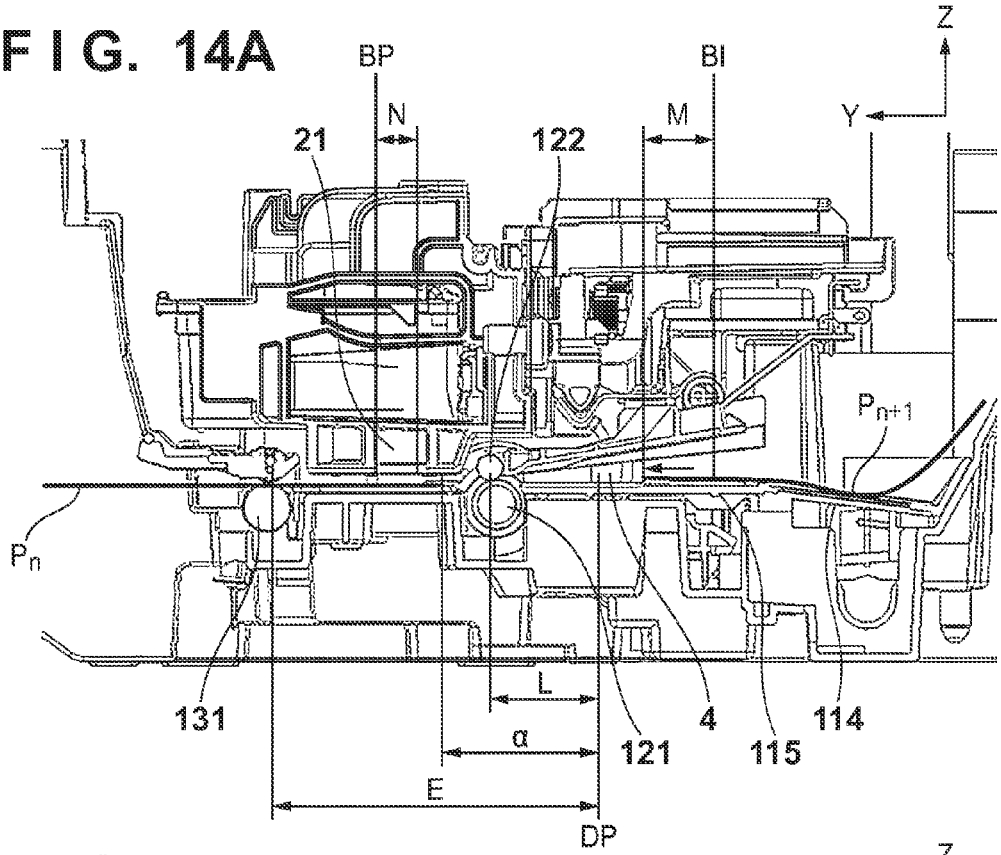
FIGS. 14A and 14B are views for explaining a feeding start timing setting method.
Figure 14B:
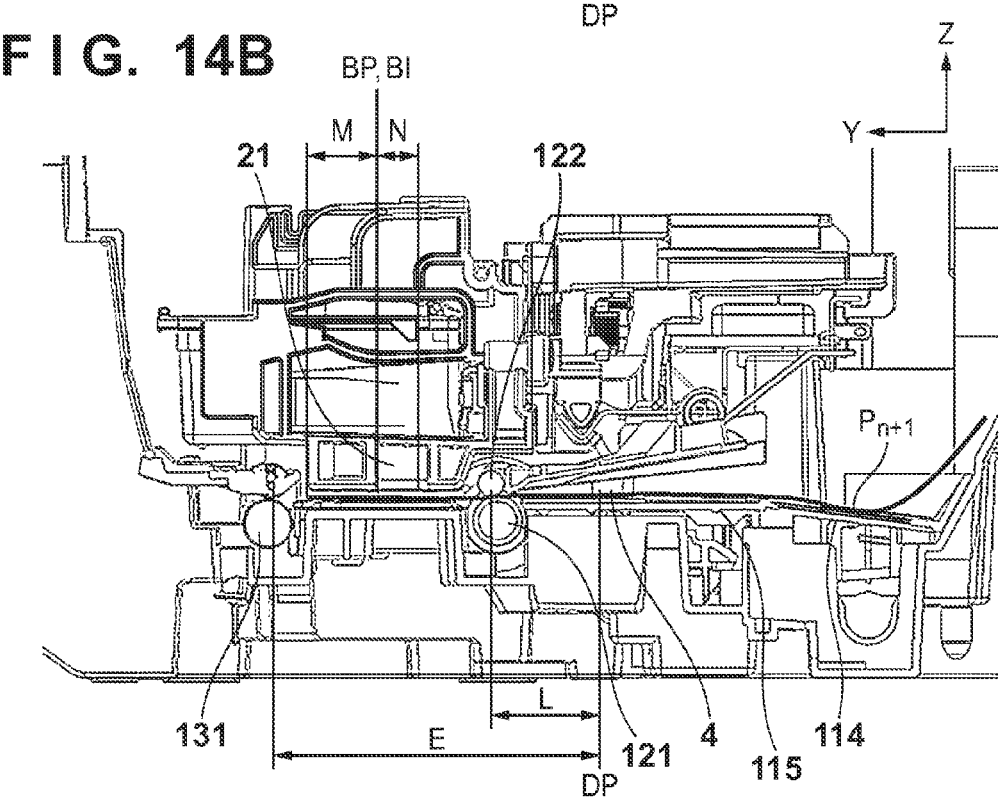

Next, the adjustment processing in step S8 will be described with reference to FIGS. 13A, 14A, and 14B. FIG. 13A is a flowchart showing the adjustment processing. FIGS. 14A and 14B are views for explaining a feeding timing setting method.

When the printing operation is continuously performed on a plurality of printing media P, the printing speed is increased by starting feeding of a subsequent printing medium P at a timing as early as possible upon completion of image printing on a preceding printing medium P. In the adjustment processing of step S8, the feeding start timing of the subsequent printing medium P is adjusted in accordance with control information of the printing operation of the subsequent printing medium P. In the embodiment, a conveyance amount upon completion of image printing on the preceding printing medium P is calculated, and the preceding printing medium P is conveyed by this conveyance amount to adjust the trailing end of the preceding printing medium P. Thereafter, the process returns to step S1 to start the feeding operation of the subsequent printing medium P. That is, by setting a conveyance amount upon completion of image printing on the preceding printing medium P, the feeding start timing of the subsequent printing medium P can be set. In the following description, the preceding printing medium P is sometimes represented by $P_n$, and the subsequent printing medium P is represented by $P_{n+1}$.

First, a method of setting the conveyance amount of the preceding printing medium $P_n$ will be explained with reference to FIGS. 14A and 14B.

A state in which after the end of image printing on the preceding printing medium $P_n$, its trailing end has not passed the nip portion of the conveying roller 121 is assumed. If the feeding operation of the subsequent printing medium $P_{n+1}$ starts in this state, the preceding printing medium $P_n$ is fed in the backward direction because the conveying roller 121 rotates in the backward direction during the feeding operation in the embodiment. To the contrary, the subsequent printing medium $P_{n+1}$ is conveyed downstream by the feeding roller 111. Thus, the trailing end of the preceding printing medium $P_n$ and the leading end of the subsequent printing medium $P_{n+1}$ collide with each other, causing a paper jam.

To prevent generation of a paper jam, a conveyance amount α upon completion of image printing on the preceding printing medium $P_n$ and after the detection unit 4 detects its trailing end needs to be larger than a distance L from the detection position DP to the nip portion of the conveying roller 121.

That is, $$\alpha > L \tag{1}$$

needs to be satisfied.

As already described above, the total printing speed is increased by starting the feeding operation of the subsequent printing medium $P_{n+1}$ at a timing as early as possible after the end of image printing on the preceding printing medium $P_n$. Hence, for example, the feeding operation of the subsequent printing medium $P_{n+1}$ can be started when the trailing end of the preceding printing medium $P_n$ exists at a position upstream of the nip portion of the discharging roller 131 in the conveyance direction.

However, if discharge of the preceding printing medium $P_n$ is not completed at the start of image printing on the subsequent printing medium $P_{n+1}$, the conveyance load acts on the conveyance motor 141. For this reason, the stop position of the subsequent printing medium $P_{n+1}$ may become unstable during image printing on the subsequent printing medium $P_{n+1}$. This may degrade the printing quality.

To prevent this, the influence of the conveyance load arising from the preceding printing medium $P_n$ needs to be eliminated. Until the subsequent printing medium $P_{n+1}$ is conveyed to the start position of image printing (step S5), the trailing end of the preceding printing medium $P_n$ is made to have passed the discharging roller 131.

The conveyance amount α of the subsequent printing medium $P_{n+1}$ to the start position of image printing can be defined by a width N and margin amount M in FIG. 14A. The width N is a distance in the sub-scanning direction between, out of the nozzles of the printhead 21, a most upstream nozzle and a most downstream nozzle which are used for image printing on the subsequent printing medium $P_{n+1}$. In FIG. 14A, BP indicates the position of the nozzle on the most downstream side, out of nozzles used for image printing. The margin amount M is a distance in the sub-scanning direction from the leading end of the subsequent printing medium $P_{n+1}$ to an image printing start position BI. FIG. 14B shows a state in which the subsequent printing medium $P_{n+1}$ is conveyed to the start position of image printing. The positions BP and BI coincide with each other.

The distance from the trailing end of the preceding printing medium $P_n$ to the discharging roller 131 is determined by a distance E from the detection position DP to the nip portion of the discharging roller 131, and the conveyance amount α after the preceding printing medium $P_n$ passes the detection position DP.

From this, the condition necessary for the trailing end of the preceding printing medium $P_n$ to have passed the discharging roller 131 when image printing on the subsequent printing medium $P_{n+1}$ starts can be represented by:

$$E-\alpha<M+N$$

that is, $$\alpha>E-M-N \tag{2}$$

To increase the printing speed without degrading the printing quality, the conveyance amount α is set to simultaneously satisfy both inequalities (1) and (2). As the conveyance amount α is smaller, the feeding start timing of the subsequent printing medium $P_{n+1}$ with respect to the preceding printing medium $P_n$ becomes earlier, increasing the printing speed. Inequalities (1) and (2) reveal that the conveyance amount α≈L is set advantageously when M or N is large, and the conveyance amount α≈E−M−N is set advantageously when M and N are small.

The image printing start position BI changes depending on an image to be printed, and the margin amount M also changes. For example, when the image printing range on the printing medium P exists on the trailing end side from the center, the margin amount M becomes larger, compared to a case in which an image is printed on the entire printing medium P. Hence, the conveyance amount α is designed to be changeable in accordance with the image printing start position BI on the subsequent printing medium $P_{n+1}$ to be fed. This is advantageous for increasing the printing speed without degrading the printing quality.

When a plurality of printing modes are prepared and can be selected, the position BP sometimes changes depending on the printing mode. The above-described example has assumed a case in which image printing is performed using all nozzles. However, the position BP of the most downstream nozzle differs between this printing mode and a printing mode in which image printing is performed by a plurality of scans.

In any case, for example, the conveyance amount α is set so that the trailing end of the preceding printing medium $P_n$ has passed the discharging roller 131 until the subsequent printing medium $P_{n+1}$ is conveyed to a position at which the positions BP and BI coincide with each other. Accordingly, feeding of the subsequent printing medium $P_{n+1}$ can be started at a more appropriate timing in accordance with even the difference in printing mode.

The adjustment processing in FIG. 13A adopts the above-described method of setting the conveyance amount α. In step S11, it is determined whether an inequality: E−M−N≥L is satisfied. This inequality is based on inequalities (1) and (2) described above. If this inequality is satisfied, the process advances to step S12; if it is not satisfied, the process advances to step S13.

In step S12, the conveyance amount α is set to be L. In step S13, the conveyance amount α is set to be E−M−N. In these processes, the two values of L and E−M−N are compared, and a smaller value is set as the conveyance amount α.

In step S14, the preceding printing medium $P_n$ is conveyed by the conveyance amount α set in step S12 or S13. As already described above, the conveyance amount α is a conveyance amount after the detection unit 4 detects the passage of the trailing end. When the image printing operation in step S6 is completed, if the detection unit 4 has not detected the passage of the trailing end of the preceding printing medium $P_n$, the preceding printing medium $P_n$ is conveyed until the passage of its trailing end is detected. Further, the preceding printing medium $P_n$ is conveyed by the conveyance amount α. When the image printing operation in step S6 is completed, if the detection unit 4 has already detected the passage of the trailing end of the preceding printing medium $P_n$, the printing medium $P_n$ is further conveyed by a conveyance amount obtained by subtracting a conveyance amount after the passage from the conveyance amount α.

As a result, the adjustment processing of one unit ends. After the adjustment processing ends, the process returns to step S1 to start feeding of the subsequent printing medium $P_{n+1}$. At this time, even if discharge of the preceding printing medium $P_n$ is not completed, the discharging roller 131 stops and thus the preceding printing medium $P_n$ also stops. When performing the processing in step S5 on the subsequent printing medium $P_{n+1}$, the preceding printing medium $P_n$ is also conveyed to complete discharge of it.

As described above, in the embodiment, backward rotation of the discharging roller 131 is restricted during feeding. With this configuration, the interval between the preceding printing medium $P_n$ and the subsequent printing medium $P_{n+1}$ can be adjusted, and the feeding start timing of the subsequent printing medium $P_{n+1}$ can be controlled based on the setting of the conveyance amount α. Since the conveying roller 121 rotates in the backward direction during feeding, skew correction of the subsequent printing medium $P_{n+1}$ can be performed. Accordingly, minimum functions necessary for the printing apparatus A can be implemented while reducing the number of driving sources.

Second Embodiment

In the first embodiment, the conveying roller 121 needs to rotate in the forward direction by a predetermined rotation amount until the arm 112 completes movement from the feeding position to the retreat position. When the arm 112 completes movement to the retreat position, the mesh position of the gears 1434 and 1433 reaches the portion 1434*a* to cut the driving transmission. However, since there is the driving transmission during the movement, the conveyance motor 141 bears the load. When the margin amount M is small, the image printing operation (step S6) may start before the arm 112 completes movement to the retreat position. If the image printing operation starts in a state in which the conveyance motor 141 bears the load for pivoting the arm 112, the stop position of the conveying roller 121 may become unstable, and the printing quality may degrade.

In the second embodiment, when a printing medium P is conveyed to the start position of image printing by a printhead 21 (step S5), a conveying roller 121 is rotated in the forward direction until at least an arm 112 completes movement to the retreat position. If an image printing start position BI passes a position BP as a result, the conveying roller 121 is rotated in the backward direction to feed the printing medium P in the backward direction and make the positions BI and BP coincide with each other. When the conveying roller 121 rotates in the backward direction, the arm 112 returns from the retreat position to the feeding position. Until a carrier 1432*b* pivots and a planet gear 1432*d* is meshed with a gear 1434, there is a time lag. By using this time lag, the printing medium P can be fed in the backward direction while the arm 112 is maintained at the retreat position.

Next, a method of setting the conveyance amount α when performing this conveyance control will be described. S is the distance between the image printing start position BI and the position BP when the arm 112 completes movement to the retreat position. The distance S is a length by which the image printing start position BI exceeds the position BP, and the minimum value is 0. In the embodiment, the aforementioned inequality (2) is rewritten into:

$$\alpha > E-M-N-S \tag{2'}$$

As α is smaller, the timing of a subsequent printing medium $P_{n+1}$ with respect to a preceding printing medium $P_n$ becomes earlier, and the total printing speed becomes higher. The total printing speed can be increased by setting α≈L when M or N is large, and setting α≈E−M−N−S when M and N are small.

Figure 13B:
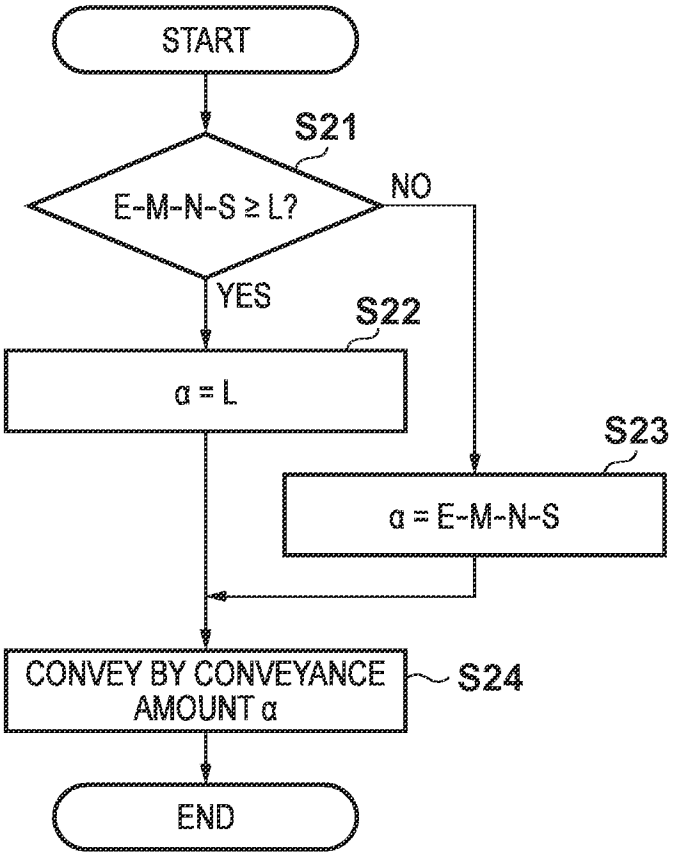
FIGS. 13A and 13B are flowcharts each showing an example of processing by the control unit in FIG. 10.

FIG. 13B shows adjustment processing according to the second embodiment. In step S21, it is determined whether an inequality: E−M−N−S≥L is satisfied. This inequality is based on inequalities (1) and (2') described above. If this inequality is satisfied, the process advances to step S22; if it is not satisfied, the process advances to step S23.

In step S22, the conveyance amount α is set to be L. In step S23, the conveyance amount α is set to be E−M−N−S. In these processes, the two values of L and E−M−N−S are compared, and a smaller value is set as the conveyance amount α.

In step S24, the preceding printing medium $P_n$ is conveyed by the conveyance amount α set in step S22 or S23. This is the same processing as that in step S14 of the first embodiment.

Accordingly, the adjustment processing of one unit ends. After the adjustment processing ends, the process returns to step S1 to start feeding of the subsequent printing medium $P_{n+1}$. At this time, even if discharge of the preceding printing medium $P_n$ is not completed, the discharging roller 131 stops and thus the preceding printing medium $P_n$ also stops. When performing the processing in step S5 on the subsequent printing medium $P_{n+1}$, the preceding printing medium $P_n$ is also conveyed to complete discharge of it. In the embodiment, the processing in step S5 includes an operation of feeding the printing medium $P_{n+1}$ in the backward direction by the distance S. After that, the image printing operation in step S6 is performed.

Other Embodiments

Figure 15:
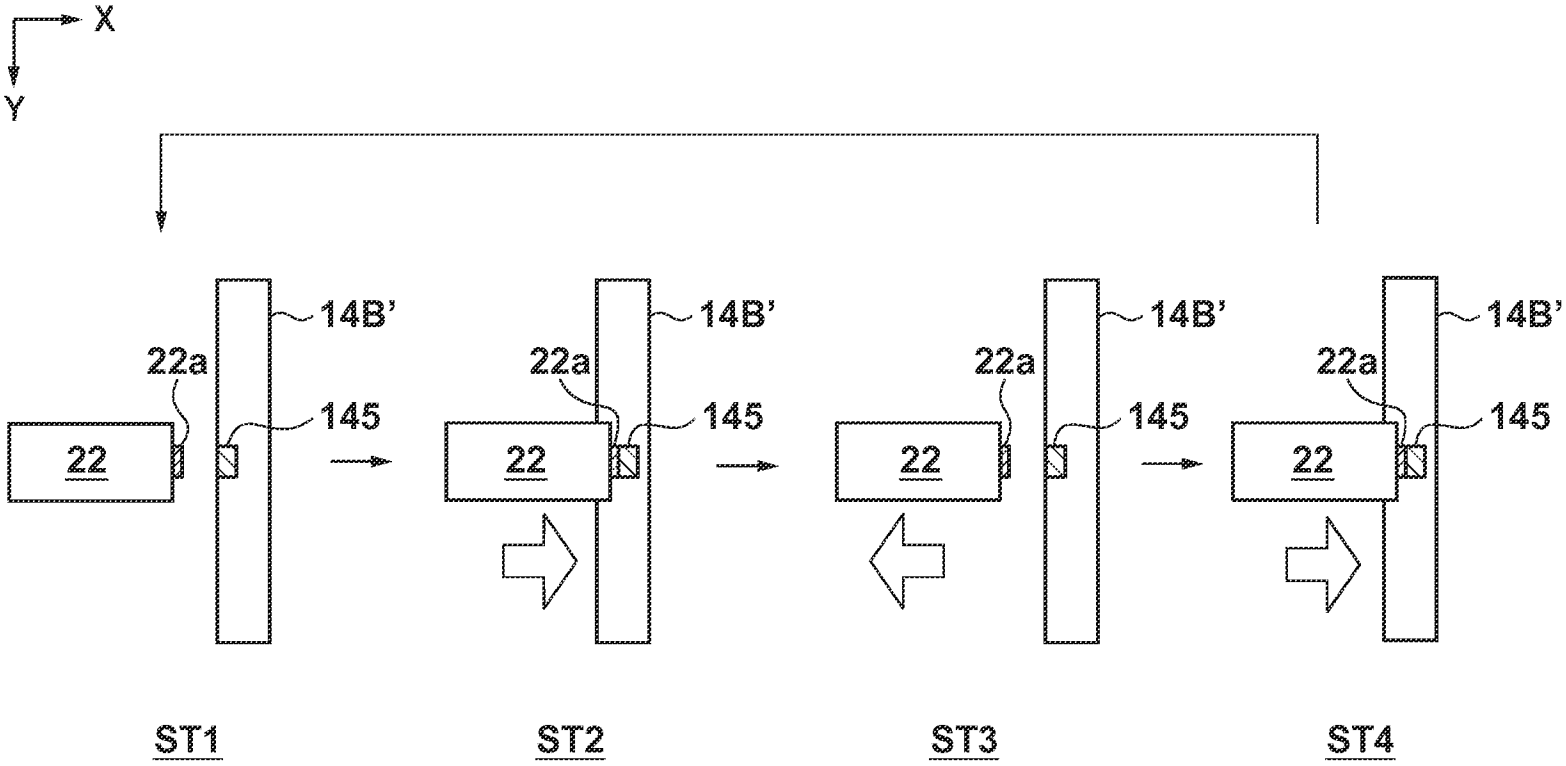
FIG. 15 is a view for explaining another example of a switching mechanism.

The planet gear mechanisms are employed as the switching mechanisms 1432, 1436, and 1442 in the above-described embodiments, but the switching mechanisms 1432, 1436, and 1442 are not limited to them. For example, a switching mechanism 1442 may be, for example, a one-way clutch which transmits a driving force when rotating a discharging roller 131 in the forward direction, and does not transmit the driving force when rotating the discharging roller 131 in the backward direction. Also, the driving states of the feeding unit 11 and discharging unit 13 are switched in accordance with the rotational direction of the conveying roller 121 in each of the above-described embodiments, but they are not limited to this. For example, the driving states may be switched using the moving force of a printing unit 2. FIG. 15 is a schematic view showing an example of this switching mechanism.

In the example of FIG. 15, an operating unit 22*a* is arranged at the end portion of a carriage 22. The operating unit 22*a* is a portion which presses a portion 145 to be operated in a driving mechanism 14B' which replaces the driving mechanism 14B. Every time the portion 145 to be operated is pressed, the switching mechanism (not shown) of the driving mechanism 14B' alternately switches the driving states of a feeding unit 11 and discharging unit 13.

In a state ST1, the operating unit 22*a* is spaced apart from the portion 145 to be operated. When switching the driving states of the feeding unit 11 and discharging unit 13, the carriage 22 is moved and the operating unit 22*a* presses the portion 145 to be operated (state ST2). The position at which the operating unit 22*a* presses the portion 145 to be operated is a position in, for example, the non-printing region in the moving range of the carriage 22. When the portion 145 to be operated is pressed, the switching mechanism (not shown) of the driving mechanism 14B' switches the driving states of the feeding unit 11 and discharging unit 13 by using the pressing force.

After that, the carriage 22 moves apart from the portion 145 to be operated, and for example, the printing operation is performed (state ST3). When switching the driving states of the feeding unit 11 and discharging unit 13 (for example, returning to the state ST1), the carriage 22 is moved to press the portion 145 to be operated by the operating unit 22*a* (state ST4). When the portion 145 to be operated is pressed, the switching mechanism (not shown) of the driving mechanism 14B' switches the driving states of the feeding unit 11 and discharging unit 13 by using the pressing force.

In this manner, by arranging the operating unit 22*a* for operating the switching mechanism in accordance with the position of the printing unit 2, the rotational direction of a conveying roller 121, and the driving states of the feeding unit 11 and discharging unit 13 can be unrelated to each other.

In each of the above-described embodiments, the feeding unit 11 includes the arm 112, and the position of the feeding roller 111 is changed by the pivot of the arm 112. However, the position of a feeding roller 111 may be fixed. In this case, the feeding enable state and feeding disable state of a printing medium P by the feeding unit 11 are implemented by the forward rotation and stop of the feeding roller 111. To the contrary, in a configuration equipped with an arm 112, as in each of the above-described embodiments, the feeding enable state and feeding disable state of the printing medium P by the feeding unit 11 can be implemented by the pivot of the arm 112. Thus, the feeding roller 111 can remain rotating.

In each of the above-described embodiments, the discharging roller 131 is stopped during the feeding operation. However, a discharging roller 131 suffices to be in a state in which it does not feed the printing medium P in the backward direction during the feeding operation. For example, the discharging roller 131 may rotate in the forward direction during the feeding operation. In this configuration, the conveyance amount $\alpha$ can be further shortened. Also, the conveying roller 121 rotates in the backward direction during the feeding operation, but may be stopped. Even if the conveying roller 121 is stopped, the above-mentioned skew correction can be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-147924, filed Jul. 16, 2013, which is hereby incorporated by reference herein in its entirety.

What is claimed is:

1. A printing apparatus comprising:

a printing unit configured to perform a printing operation of printing an image on a printing medium;

a conveying unit arranged upstream of said printing unit in a conveyance direction of a printing medium, and configured to convey a printing medium;

a driving source configured to drive said conveying unit, said conveying unit conveying a printing medium in the conveyance direction when said driving source rotates in a first direction, and said conveying unit conveying a printing medium in a direction opposite to the conveyance direction when said driving source rotates in a second direction;

a feeding unit arranged upstream of said conveying unit in the conveyance direction and configured to perform a feeding operation for a printing medium by transmission of a driving of said driving source, the driving of said driving source not transmitted to said feeding unit when said driving source rotates in the first direction, and the driving of said driving source transmitted to said feeding unit when said driving source rotates in the second direction;

a discharging unit arranged downstream of said printing unit in the conveyance direction and configured to perform a discharging operation for a printing medium by transmission of the driving of said driving source, the driving of said driving source being transmitted to said discharging unit when said driving source rotates in the first direction, and the driving of said driving source not transmitted to said discharging unit when said driving source rotates in the second direction; and a control unit configured to perform a control in which:

after the printing operation for a first printing medium is completed, the first printing medium is conveyed by a conveyance amount by the driving source rotating in the first direction, the conveyance amount being calculated based on a printing start position on a second printing medium which is subsequent to the first printing medium, and after the first printing medium is conveyed by the conveyance amount, the feeding operation for the second printing medium is started by changing a rotation direction of said driving source from the first direction to the second direction before the discharging operation for the first printing medium is completed.

2. The apparatus according to claim 1, further comprising a detection unit configured to detect passage of a trailing end of a printing medium, wherein a detection position of said detection unit is a position upstream of said conveying unit in the conveyance direction and downstream of said feeding unit in the conveyance direction, and said control unit is configured to set a feeding start timing of the second printing medium based on a detection result of said detection unit regarding the first printing medium, and the printing start position on the second printing medium.

3. The apparatus according to claim 1, wherein said conveying unit includes a conveying roller, and the conveying roller rotates so as to convey a printing medium in a direction opposite the conveyance direction when said driving source rotates in the second direction.

4. The apparatus according to claim 1, wherein said conveying unit includes a conveying roller, said feeding unit includes a feeding roller, said discharging unit includes a discharging roller, said driving source includes a motor, the rotational direction of the conveying roller is switched by rotation of the motor, and said apparatus further includes:

a planet gear arranged in a transmission path of a driving force from the motor to the feeding roller; and a planet gear arranged in a transmission path of a driving force from the motor to the discharging roller.

5. The apparatus according to claim 1, wherein said control unit is configured to perform a control in which after said feeding unit starts the feeding operation for a printing medium, the printing medium abuts against said conveying unit which is under an operation state to convey a printing medium in the direction opposite to the conveyance direction.

6. A printing apparatus comprising:

a printing unit configured to perform a printing operation of printing an image on a printing medium;

a conveying roller arranged upstream of said printing unit in a conveyance direction of a printing medium, and configured to convey a printing medium;

a driving source configured to drive said conveying roller, said conveying roller conveying a printing medium in the conveyance direction when said driving source rotates in a first direction, and said conveying roller conveying a printing medium in a direction opposite to the conveyance direction when said driving source rotates in a second direction;

a feeding roller arranged upstream of said conveying roller in the conveyance direction and configured to perform a feeding operation for a printing medium by transmission of a driving of said driving source, the driving of said driving source not transmitted to said feeding roller when said driving source rotates in the first direction, and the driving of said driving source transmitted to said feeding roller when said driving source rotates in the second direction;

a discharging roller arranged downstream of said printing unit in the conveyance direction and configured to perform a discharging operation for a printing medium by transmission of the driving of said driving source, the driving of said driving source transmitted to said discharging roller when said driving source rotates in the first direction, and the driving of said driving source not transmitted to said discharging roller when said driving source rotates in the second direction; and a control unit configured to perform a control in which:

after the printing operation for a first printing medium is completed, the first printing medium is conveyed by a conveyance amount by the driving source rotating in the first direction, the conveyance amount being calculated based on a printing start position on a second printing medium which is subsequent to the first printing medium; and after the first printing medium is conveyed by the conveyance amount, the feeding operation for the second printing medium is started by changing a rotation direction of said driving source from the first direction to the second direction before the discharging operation for the first printing medium is completed.

7. The apparatus according to claim 6, further comprising a detection unit configured to detect passage of a trailing end of a printing medium, wherein a detection position of said detection unit is a position upstream of said conveying roller in the conveyance direction and downstream of said feeding roller in the conveyance direction, and said control unit is configured to set a feeding start timing of the second printing medium based on a detection result of said detection unit regarding the first printing medium, and the printing start position on the second printing medium.

8. The apparatus according to claim 6, wherein said driving source includes a motor, and said apparatus further includes:

a planet gear arranged in a transmission path of a driving force from the motor to said feeding roller; and a planet gear arranged in a transmission path of a driving force from the motor to said discharging roller.

9. The apparatus according to claim 6, wherein said control unit is configured to perform a control in which after said feeding roller starts the feeding operation for a printing medium, the printing medium abuts against said conveying roller which is under an operation state to convey a printing medium in the direction opposite to the conveyance direction.

10. A method of controlling a printing apparatus, the printing apparatus including:

a printing unit configured to perform a printing operation of printing an image on a printing medium;

a conveying unit arranged upstream of the printing unit in a conveyance direction of a printing medium, and configured to convey a printing medium;

a driving source configured to drive the conveying unit, the conveying unit conveying a printing medium in the conveyance direction when the driving source rotates in a first direction, and said conveying unit conveying a printing medium in a direction opposite to the conveyance direction when the driving source rotates in a second direction;

a feeding unit arranged upstream of the conveying unit in the conveyance direction and configured to perform a feeding operation for a printing medium by transmission of a driving of the driving source, the driving of the driving source not transmitted to the feeding unit when the driving source rotates in the first direction, and the driving of the driving source transmitted to the feeding unit when the driving source rotates in the second direction; and a discharging unit arranged downstream of the printing unit in the conveyance direction and configured to perform a discharging operation for a printing medium by transmission of the driving of the driving source, the driving of the driving source being transmitted to the discharging unit when the driving source rotates in the first direction, and the driving of the driving source not transmitted to the discharging unit when the driving source rotates in the second direction, the control method comprising the steps of:

conveying, after the printing operation for a first printing medium is completed, the first printing medium by a conveyance amount by the driving source rotating in the first direction, the conveyance amount being calculated based on a printing start position on a second printing medium which is subsequent to the first printing medium; and starting, after the first printing medium is conveyed by the conveyance amount, the feeding operation for the second printing medium by changing a rotation direction of said driving source from the first direction to the second direction before the discharging operation for the first printing medium is completed.

11. A method of controlling a printing apparatus, the printing apparatus including:

a printing unit configured to perform a printing operation of printing an image on a printing medium;

a conveying roller arranged upstream of the printing unit in a conveyance direction of a printing medium, and configured to convey a printing medium;

a driving source configured to drive the conveying roller, the conveying roller conveying a printing medium in the conveyance direction when the driving source rotates in a first direction, and the conveying roller conveying a printing medium in a direction opposite to the conveyance direction when the driving source rotates in a second direction;

a feeding roller arranged upstream of the conveying roller in the conveyance direction and configured to perform a feeding operation for a printing medium by a transmission of a driving of the driving source, the driving of the driving source being not transmitted to the feeding roller when the driving source rotates in the first direction, and the driving of the driving source being transmitted to the feeding roller when the driving source rotates in the second direction; and a discharging roller arranged downstream of the printing unit in the conveyance direction and configured to perform a discharging operation for a printing medium by a transmission of the driving of the driving source, the driving of the driving source being transmitted to the discharging roller when the driving source rotates in the first direction, and the driving of the driving source being not transmitted to the discharging roller when the driving source rotates in the second direction, the control method comprising the steps of:

conveying, after the printing operation for a first printing medium is completed, the first printing medium by a conveyance amount by the driving source rotating in the first direction, the conveyance amount being calculated based on a printing start position on a second printing medium which is subsequent to the first printing medium; and starting, after the first printing medium is conveyed by the conveyance amount, the feeding operation for the second medium by changing a rotation direction of the driving source from the first direction to the second direction before the discharging operation for the first printing medium is completed.

12. A printing apparatus comprising:

a printing unit configured to perform a printing operation of printing an image on a printing medium;

a first conveying roller arranged upstream of said printing unit in a conveyance direction of a printing medium in the printing operation, and configured to convey a printing medium;

a motor configured to drive said first conveying roller, said first conveying roller rotating in a forward direction when said motor rotates in a first direction, and said first conveying roller rotating in a reverse direction when said motor rotates in a second direction;

a feeding roller arranged upstream of said first conveying roller in the conveyance direction and configured to feed a printing medium by a driving of said motor, said feeding roller not rotating when said motor rotates in the first direction, and said feeding roller rotating in a forward direction when said motor rotates in the second direction;

a second conveying roller arranged downstream of said printing unit in the conveyance direction and configured to convey a printing medium, said second conveying roller rotating in a forward direction when said motor rotates in the first direction, and said second conveying roller not rotating when said motor rotates in the second direction; and a control unit configured to perform a control in which after the printing operation for a first printing medium is completed, the first printing medium is conveyed in the conveyance direction by a conveyance amount determined based on a position of a trailing end of the first printing medium and a printing start position on a second printing medium which is subsequent to the first printing medium and then a rotational direction of said motor is changed from the first direction to the second direction before the trailing end of the first printing medium passes through said second conveying roller.

13. The apparatus according to claim 12, wherein if the trailing end of the first printing medium does not pass through said first conveying roller when the printing operation for the first printing medium is completed, said control unit is configured to convey the first printing medium in the conveyance direction until the trailing end of the first printing medium passes through said first conveying roller and then to change the rotational direction of said motor from the first direction to the second direction.

14. The apparatus according to claim 12, wherein said control unit is configured to determine the conveyance amount so that the trailing end of the first printing medium passes through said second conveying roller when the second printing medium is conveyed to the printing start position.

* * * * *